US011008841B2

(12) United States Patent
Apperley et al.

(10) Patent No.: US 11,008,841 B2
(45) Date of Patent: May 18, 2021

(54) SELF-FORMING TRAVELLING WAVE ANTENNA MODULE BASED ON SINGLE CONDUCTOR TRANSMISSION LINES FOR ELECTROMAGNETIC HEATING OF HYDROCARBON FORMATIONS AND METHOD OF USE

(71) Applicant: Acceleware Ltd., Calgary (CA)

(72) Inventors: Thomas Apperley, Calgary (CA); Michal M. Okoniewski, Calgary (CA)

(73) Assignee: Acceleware Ltd., Calgary (CA)

( * ) Notice: Subject to any disclaimer, the term of this patent is extended or adjusted under 35 U.S.C. 154(b) by 306 days.

(21) Appl. No.: 16/100,761

(22) Filed: Aug. 10, 2018

(65) Prior Publication Data

US 2019/0048696 A1 Feb. 14, 2019

Related U.S. Application Data

(60) Provisional application No. 62/544,313, filed on Aug. 11, 2017.

(51) Int. Cl.
*E21B 43/24* (2006.01)
*H01Q 1/36* (2006.01)
(Continued)

(52) U.S. Cl.
CPC ..... *E21B 43/2401* (2013.01); *H01Q 1/04* (2013.01); *H01Q 1/08* (2013.01); *H01Q 1/36* (2013.01);
(Continued)

(58) Field of Classification Search
CPC .... E21B 43/2401; E21B 43/30; E21B 43/305; H01Q 1/04; H01Q 13/203
See application file for complete search history.

(56) References Cited

U.S. PATENT DOCUMENTS 2,402,622 A 6/1946 Hansen
2,757,738 A 8/1956 Ritchey
(Continued)

FOREIGN PATENT DOCUMENTS

CA 2816101 A1 5/2012
CA 2816297 A1 5/2012
(Continued)

OTHER PUBLICATIONS

Sresty et al., "Recovery of Bitumen from Tar Sand Deposits with the Radio Frequency Process," SPE 10229, Reservor Engineering, 1986, p. 85-94.
(Continued)

*Primary Examiner* — Blake E Michener
(74) *Attorney, Agent, or Firm* — Bereskin & Parr LLP/S.E.N.C.R.L., s.r.l.; Isis E. Caulder

(57) ABSTRACT

An apparatus and method for electromagnetic heating of a hydrocarbon formation is presented. The apparatus is a radio frequency antenna module in a radio frequency antenna for delivering electromagnetic energy generated by a generator into the hydrocarbon formation. The antenna module comprises: a conductive member; at least one conductive sheath with a first and second end surrounding at least one portion of the conductive member; at least one electrical coupler electrically coupled to the conductive member and the at least one conductive sheath for receiving the electrical energy; and an electrically insulating seal inserted at the first and second end of each of the at least one conductive sheath between the conductive member and the conductive sheath to maintain an enclosed cavity defined by the conductive member, the conductive sheath and the electrically insulating seal.

29 Claims, 19 Drawing Sheets

(51) Int. Cl.

| | |
|---|---|
| ***H05B 6/52*** | (2006.01) |
| ***H01Q 13/20*** | (2006.01) |
| ***H01Q 1/04*** | (2006.01) |
| ***H01P 3/06*** | (2006.01) |
| ***H01Q 1/08*** | (2006.01) |
| ***H01Q 9/04*** | (2006.01) |

(52) U.S. Cl.
CPC ..... *H01Q 9/0471* (2013.01); *H01Q 13/20* (2013.01); *H05B 6/52* (2013.01); *H01P 3/06* (2013.01); *H05B 2214/03* (2013.01)

(56) References Cited

U.S. PATENT DOCUMENTS

| | | | | |
|---|---|---|---|---|
| 3,169,577 | A | 2/1965 | Sarapuu | |
| 3,170,519 | A | 2/1965 | Haagensen | |
| 3,522,848 | A | 8/1970 | New | |
| 3,909,757 | A | 9/1975 | Miyamoto et al. | |
| 4,135,579 | A | 1/1979 | Rowland et al. | |
| 4,140,179 | A | 2/1979 | Kasevich et al. | |
| 4,144,935 | A | 3/1979 | Bridges | |
| RE30,738 | E | 9/1981 | Bridges et al. | |
| 4,301,865 | A | 11/1981 | Kasevich et al. | |
| 4,487,257 | A | 12/1984 | Dauphiné | |
| 4,490,727 | A | 12/1984 | Kowols | |
| 4,508,168 | A | 4/1985 | Heeren | |
| 4,513,815 | A | 4/1985 | Rundell et al. | |
| 4,583,589 | A | 4/1986 | Kasevich | |
| 4,620,593 | A | 11/1986 | Haagensen | |
| 5,236,039 | A | 8/1993 | Edelstein et al. | |
| 5,293,936 | A | 3/1994 | Bridges | |
| 5,484,985 | A | 1/1996 | Edelstein et al. | |
| 6,189,611 | B1 | 2/2001 | Kasevich | |
| 6,285,014 | B1 | 9/2001 | Beck et al. | |
| 6,413,399 | B1 | 7/2002 | Kasevich | |
| 7,009,471 | B2 | 3/2006 | Elmore | |
| 7,075,392 | B2 | 7/2006 | Smith et al. | |
| 7,182,151 | B2 | 2/2007 | Stump et al. | |
| 7,194,297 | B2 | 3/2007 | Talpade et al. | |
| 7,250,916 | B2 | 7/2007 | Kunysz et al. | |
| 7,312,428 | B2 | 12/2007 | Kinzer | |
| 7,567,154 | B2 | 7/2009 | Elmore | |
| 7,817,101 | B2 | 10/2010 | Cowles | |
| 7,891,421 | B2 | 2/2011 | Kasevich | |
| 8,196,658 | B2 | 6/2012 | Miller et al. | |
| 8,453,739 | B2 | 6/2013 | Parsche | |
| 8,763,692 | B2 | 7/2014 | Parsche | |
| 8,772,683 | B2 | 7/2014 | Parsche | |
| 8,836,594 | B2 | 9/2014 | Rothwell et al. | |
| 9,016,367 | B2 * | 4/2015 | Wright | F16L 39/005 166/248 |
| 9,151,146 | B2 | 10/2015 | Rey-Bethbeder et al. | |
| 9,222,343 | B2 | 12/2015 | Menard et al. | |
| 9,376,899 | B2 * | 6/2016 | Wright | H01Q 1/44 |
| 9,938,809 | B2 | 4/2018 | Okoniewski et al. | |
| 10,165,630 | B2 | 12/2018 | Okoniewski et al. | |
| 2001/0011590 | A1 | 8/2001 | Thomas et al. | |
| 2004/0084442 | A1 | 5/2004 | La Rovere | |
| 2006/0102625 | A1 | 5/2006 | Kinzer | |
| 2007/0252568 | A1 | 11/2007 | Chien | |
| 2008/0073079 | A1 | 3/2008 | Tranquilla et al. | |
| 2009/0173488 | A1 | 7/2009 | Varma | |
| 2011/0006055 | A1 | 1/2011 | Diehl | |
| 2011/0042063 | A1 | 2/2011 | Diehl et al. | |
| 2011/0094755 | A1 | 4/2011 | Corbett et al. | |
| 2011/0253367 | A1 | 10/2011 | Banerjee et al. | |
| 2012/0018140 | A1 | 1/2012 | Parsche | |
| 2012/0061380 | A1 * | 3/2012 | Parsche | E21B 43/2401 219/618 |
| 2012/0125609 | A1 | 5/2012 | Parsche | |
| 2012/0305239 | A1 * | 12/2012 | Sultenfuss | E21B 43/24 166/248 |
| 2013/0180729 | A1 * | 7/2013 | Wright | E21B 36/04 166/380 |
| 2013/0277045 | A1 | 10/2013 | Parsche | |
| 2013/0334205 | A1 | 12/2013 | Wright et al. | |
| 2014/0110395 | A1 | 4/2014 | Parsche | |
| 2014/0224472 | A1 * | 8/2014 | Parsche | E21B 43/2401 166/60 |
| 2014/0262222 | A1 | 9/2014 | Wright et al. | |
| 2014/0262224 | A1 | 9/2014 | Ayers et al. | |
| 2014/0262225 | A1 | 9/2014 | Campbell et al. | |
| 2014/0266951 | A1 | 9/2014 | Okoniewski et al. | |
| 2014/0300520 | A1 | 10/2014 | Nguyen et al. | |
| 2015/0013967 | A1 | 1/2015 | Parsche | |
| 2015/0192004 | A1 | 7/2015 | Saeedfar | |
| 2015/0322759 | A1 | 11/2015 | Okoniewski et al. | |
| 2016/0168977 | A1 | 6/2016 | Donderici et al. | |
| 2017/0231035 | A1 * | 8/2017 | Okoniewski | H05B 6/708 |

FOREIGN PATENT DOCUMENTS

| | | | |
|---|---|---|---|
| CA | 2895595 | A1 | 12/2015 |
| CA | 2881763 | C | 8/2016 |
| WO | 2008/115359 | A1 | 9/2008 |
| WO | 2009/049358 | A1 | 4/2009 |
| WO | 2012/067769 | A2 | 5/2012 |
| WO | 2012/067770 | A1 | 5/2012 |
| WO | 2015/128497 | A1 | 9/2015 |
| WO | 2016/0024197 | A2 | 2/2016 |
| WO | 2016/024198 | A2 | 2/2016 |

OTHER PUBLICATIONS

Sutinjo et al., "Radiation from Fast and Slow Traveling Waves", IEEE Antennas Propag., 2008, vol. 50, pp. 175-181.

International Search Report and Written Opinion dated Dec. 15, 2015 in related International Patent Application No. PCT/CA2015/051009 (7 pages).

Wacker, et al., "Electromagnetic Heating for In-Situ Production of Heavy Oil and Bitumen Reservoirs", Society of Petroleum Engineers, 2011, pp. 1-14, Calgary, Canada.

Non-final Office Action and Notice of References Cited dated Feb. 22, 2017 in related U.S. Appl. No. 14/508,423 (33 pages).

Non-final Office Action and Notice of References Cited dated Jan. 22, 2020 in U.S. Appl. No. 15/907,535 (9 pages).

International Search Report and Written Opinion dated May 10, 2017 in related International Patent Application No. PCT/CA2017/050104 (7 pages).

Pauli et al., "Impedance Matching of a Coaxial Antenna for Microwave In-situ Processing of Polluted Soils", retrieved rom Journal of Microwave Power and Electromagnetic Energy, 2011, 45(2): 70-78.

Non-final Office Action and Notice of References Cited dated Jan. 22, 2018 in related U.S. Appl. No. 15/016,785 (14 pages).

Pauli et al., "A dielectric traveling wave antenna for microwave assisted soil remediation", Mediterranean Microwave Symposium, Budapest, Hungary, 2007 (4 pages).

Extended European Search Report dated Aug. 10, 2017 in related EP Patent Application No. 15849646.3 (7 pages).

International Search Report and Written Opinion dated May 25, 2020 in International Patent Application No. PCT/CA2020/050279 (8 pages).

* cited by examiner

SELF-FORMING TRAVELLING WAVE ANTENNA MODULE BASED ON SINGLE CONDUCTOR TRANSMISSION LINES FOR ELECTROMAGNETIC HEATING OF HYDROCARBON FORMATIONS AND METHOD OF USE

FIELD

The embodiments described herein relate to the field of heating hydrocarbon formations, and in particular to antenna modules for electromagnetically heating hydrocarbon formations.

BACKGROUND

Electromagnetic (EM) heating can be used for enhanced recovery of hydrocarbons from underground reservoirs. Similar to traditional steam-based technologies, the application of EM energy to heat hydrocarbon formations can reduce viscosity and mobilize bitumen and heavy oil within the hydrocarbon formation for production. However, the use of EM heating can require less fresh water than traditional steam-based technologies. As well, the heat transfer with EM heating can be more efficient than that of traditional steam-based technologies, leading to lower capital and operational expenses. The lower cost of EM heating provides the potential to unlock oil reservoirs that would otherwise be unviable or uneconomical for production with steam-based technologies such as shallow formations, thin formations, formations with thick shale layers, and mine-face accessible hydrocarbon formations, for example. Hydrocarbon formations can include heavy oil formations, oil sands, tar sands, carbonate formations, sale oil formations, and other hydrocarbon bearing formations.

EM heating of hydrocarbon formations can be achieved by using an EM radiator, or antenna, or applicator, positioned inside an underground reservoir to radiate EM energy to the hydrocarbon formation. The antenna is typically operated resonantly. The antenna can receive EM power generated by an EM wave generator, or radio frequency (RF) generator.

As the hydrocarbon formation is heated, the characteristics of the hydrocarbon formation, and in particular, the impedance of the hydrocarbon formation, can change. In order to maintain efficient power transfer to the hydrocarbon formation, dynamic or static impedance matching networks can be used between the antenna and the RF generator to limit the reflection of EM power from the antenna back to the RF generator. As well, the RF generator can be adjusted to limit the reflection of EM power from the antenna back to the RF generator. Such operational adjustments and impedance matching networks increase operational, equipment, and design costs.

SUMMARY

According to one aspect, there is provided a radio frequency antenna module in a radio frequency antenna for delivering electromagnetic energy generated by a generator into a hydrocarbon formation, the antenna module comprising: a conductive member; at least one conductive sheath with a first and second end surrounding at least one portion of the conductive member; at least one electrical coupler electrically coupled to the conductive member and the at least one conductive sheath for receiving the electrical energy; and an electrically insulating seal inserted at the first and second end of each of the at least one conductive sheath between the conductive member and the conductive sheath to maintain an enclosed cavity defined by the conductive member, the conductive sheath and the electrically insulating seal for electrically separating the conductive member and the conductive sheath.

In at least one embodiment, the electromagnetic energy radiates with a frequency between 1 kHz and 100 MHz.

In at least one embodiment, the conductive member comprises a first and second connector located at a first member end and a second member end, respectively, such that a plurality of irradiating modules are connectable to form at least one module chain.

In at least one embodiment, the first and second connector are electrically conductive such that each of the at least one module chain comprises a contiguous conductive member.

In at least one embodiment, the at least one module chain comprises a plurality of chains such that a first module chain set is configured to radiate independently of another module chain set.

In at least one embodiment, the first module chain set radiates at a first target frequency and the other module chain set radiates at a second target frequency.

In at least one embodiment, the conductive member is a pipe and each of the first and second connector provides a sealed connection that prohibits flow of fluids from the hydrocarbon formation into the pipe.

In at least one embodiment, the at least one conductive sheath comprises an inner conducting surface and an outer conducting surface; and for each of the at least one conductive sheath, a segment of coaxial transmission line having an inner and outer conductor is defined by that conductive sheath and a corresponding surrounded portion of the conductive member such that the outer conductor comprises the inner conducting surface of that conductive sheath and the inner conductor comprises a corresponding portion of the conductive member surrounded by that conductive sheath.

In at least one embodiment, a first sheath has a diameter that is different from at least one other conductive sheath.

In at least one embodiment, the conductive member has at least one surrounded conductive member portion and at least one exposed conductive member portion, and the antenna module further comprises: at least one segment of an inner single-conductor transmission line defined by the at least one exposed conductive member portion; and at least one segment of an outer single-conductor transmission line defined by the outer conductive surface of the at least one conductive sheath.

In at least one embodiment, the conductive member is a pipe comprising at least one feed transmission line that delivers the electromagnetic energy to the antenna module; and the at least one electrical coupler comprises at least two feed connectors located between two ends of the segment of coaxial transmission line such that each feed connector is connected to i) a feed transmission line at a first feed connector port; and ii) at least one of a) the inside of the hollow pipe and b) the inner conducting surface of at least one conductive sheath at a second port.

In at least one embodiment, the at least one feed connector a plurality of feed connectors are azimuthally arranged around an inner surface of the pipe.

In at least one embodiment, the at least one feed connector comprises a plurality of feed connectors that are arranged axially along an inner surface of the hollow pipe.

In at least one embodiment, the at least one feed connector is located near one end of the segment of coaxial transmission line.

In at least one embodiment, the segment of coaxial transmission line has an electrical length that is substantially one half of a wavelength of the electromagnetic energy oscillating at a target frequency such that a perfect electric conductor boundary condition is defined in a plane that is situated at a mid-point of the segment of coaxial transmission line and oriented transversely relative to a longitudinal axis defined the conductive member.

In at least one embodiment, the at least one feed connector is located near a midpoint of the segment of coaxial transmission line.

In at least one embodiment, the segment of coaxial transmission line has an electrical length that is substantially one half of a wavelength of the electromagnetic energy oscillating at a target frequency such that a perfect magnetic conductor boundary condition is defined in a plane that is situated at a mid-point of the segment of coaxial transmission line and oriented transversely relative to a longitudinal axis defined the conductive member.

In at least one embodiment, the segment of coaxial transmission line has an electrical length that is substantially an odd multiple of one half of a wavelength the electromagnetic energy oscillating at a target frequency.

In at least one embodiment, the enclosed cavity comprises at least one dielectric material to separate the inner and outer conductor of the segment of coaxial transmission line.

In at least one embodiment, the electromagnetic energy generates electromagnetic heating to produce at least one evaporated zone in the hydrocarbon formation surrounding the antenna module to define a second coaxial transmission line comprising: a second inner conductor defined by portions of the inner single-conductor transmission line and the outer single-conductor transmission line; and a second outer conductor comprising an outer boundary separating the evaporated zone and the hydrocarbon formation.

In at least one embodiment, the seal is configured with at least one of the following properties: i) prohibits flow of fluids from the hydrocarbon formation into the enclosed cavity; ii) chemically inert; and iii) electrically insulating.

In at least one embodiment, the seal is toroidal in shape with a rectangular cross-section and further comprises concentric inner and outer structural rings, the inner structural ring located proximally to the conductive member and the outer structural ring located proximally to the conductive sheath.

In at least one embodiment, the inner and outer structural rings have an electrical loss tangent of less than 0.01.

In at least one embodiment, the conductive member has a diameter that varies along its length such that the diameter is larger at the at least one exposed conductive portion relative to the at least one surrounded conductive member portion to produce a flared conductive member.

According to one aspect, there is provided method for electromagnetic heating of a hydrocarbon formation comprising: deploying at least one antenna module into the hydrocarbon formation; operating at least one electromagnetic wave generator to generate at least one electromagnetic wave having at least one target frequency; electrically coupling the at least one antenna module to the at least one electromagnetic wave generator; and delivering at least one electromagnetic wave to the hydrocarbon formation, the electromagnetic wave corresponding to electromagnetic energy used to generate heat within the hydrocarbon formation.

In at least one embodiment, the electrically coupling comprises coupling a first electromagnetic wave generator to a first set of antenna modules and coupling a second electromagnetic wave generator to a second set of antenna modules so that the first set of antenna modules irradiates the hydrocarbon formation independently relative to the second set of antenna modules.

In at least one embodiment, the method further comprises configuring the first electromagnetic wave generator to generate a first electromagnetic wave at a first frequency; and configuring the second electromagnetic wave generator to generate a second electromagnetic wave a second frequency, wherein the first frequency is different from the second frequency.

In at least one embodiment, the deploying the at least one antenna module comprises connecting a plurality of antenna modules to form at least one module chain and deploying the at least one module chain into the hydrocarbon formation, wherein each antenna module in the plurality of antenna modules is connectable to another antenna module using a first and second electrically conductive connector located at a respective first member end and a second member end of the conductive member so that each module chain comprises a contiguous conductive member.

In at least one embodiment, the method further comprises determining a length of the at least one conductive sheath based on at least one of i) the at least one target frequency; ii) an outer diameter of the conducting member the at least one antenna module; iii) an outer diameter of the at last one conductive sheath; iv) material occupying the enclosed cavity; and v) electrical characteristics of the hydrocarbon formation.

Further aspects and advantages of the embodiments described herein will appear from the following description taken together with the accompanying drawings.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

Figure 1:
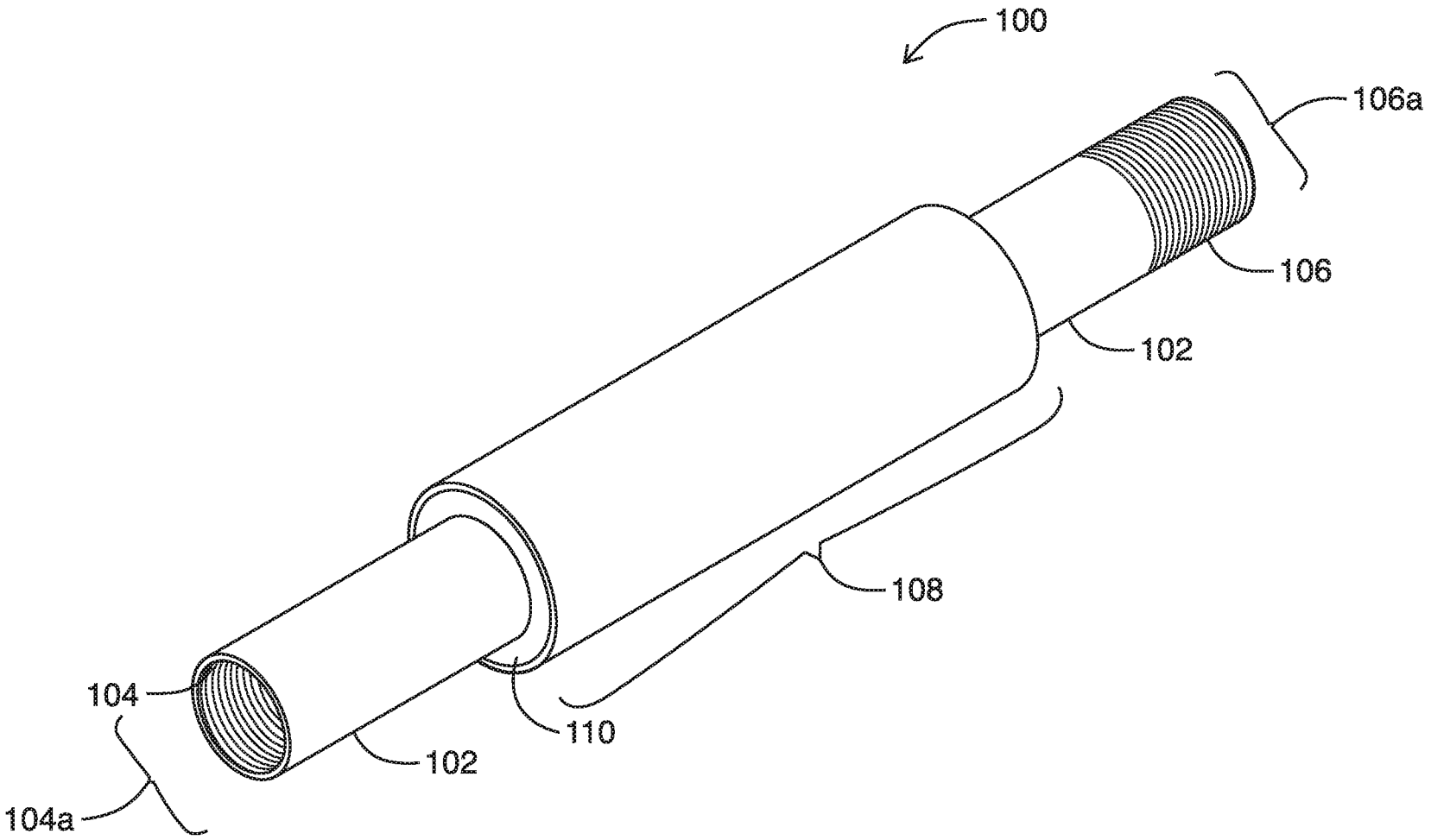
FIG. 1 is a perspective view of an excitation module for electromagnetic heating of hydrocarbon formations according to at least one embodiment.

The skilled person in the art will understand that the drawings, described below, are for illustration purposes only. The drawings are not intended to limit the scope of the applicants' teachings in anyway. Also, it will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF VARIOUS EMBODIMENTS

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementation of the various embodiments described herein.

It should be noted that terms of degree such as "substantially", "about" and "approximately" when used herein mean a reasonable amount of deviation of the modified term such that the end result is not significantly changed. These terms of degree should be construed as including a deviation of the modified term if this deviation would not negate the meaning of the term it modifies.

In addition, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

It should be noted that the term "coupled" used herein indicates that two elements can be directly coupled to one another or coupled to one another through one or more intermediate elements.

The electromagnetic (EM) heating of hydrocarbon formations such as heavy oil formations can be an attractive Enhanced Oil Recovery (EOR) technology for reasons that include the potential for unlocking heavy oil reservoirs which would generally not be economically produced using more traditional steam-based technology (e.g. shallow formations, thin formations, formations with thick shale layers, etc.); lower greenhouse gas emissions and significant reduction or complete elimination of the need for fresh water can reduce environmental impact; and improved efficiency from an energy balance point of view compared to the steam-based technologies as EM heating creates and maintains smaller amounts of steam inside the heavy oil reservoir.

An EM radiator in EM EOR solutions generally have a form of a single or multiple linear or loop radiators positioned inside a heavy oil reservoir. A radiator can be sometimes referred to as an antenna or applicator. The EM power can be generated on the surface from a power source, for example, an AC or DC power source. The EM generator is often referred to as a Radio Frequency (RF) generator. The EM generator generates power in the radio frequency range, typically between 100 kHz and 100 MHz. However in some cases the EM generator can be configured to generate in other frequency ranges such as from 50 kHz to 50 MHz or 1 kHz to 100 MHz. The generated power can then be transferred to the EM radiator using a feed transmission line such as a single conductor cable or a multiple conductor cable such as a coaxial cable.

The EM radiator radiates the EM power into the formation using a radiator such as a resonant antenna. The resonant antenna's operating frequency depends on the EM properties of the formation around the antenna and the antenna's length. This means that antennas designed for different formations and different well lengths may use different operating frequencies, requiring different impedance matching circuits and EM generators. Therefore, current EM heating systems are generally custom designed for each well, increasing the cost of the system. Moreover, as the EM properties of the formation change during the heating process, the antenna electrical characteristics may also change and require some form of variable impedance matching. For example, a system of dynamic or static matching networks can be required in-situ between the transmission line delivering EM power and the antenna to improve the efficiency of the heating system. Alternatively, such a system for impedance may be installed on the surface between the EM generator and the transmission line to limit the reflection of the EM power from the antenna back to the generator.

Additionally, most existing EM heating applications propose complex antenna systems that may require at least the following: isolation of conductor sections; an electrically lossless casing; designs using machined surfaces, for example grooves or slots; the use of exotic materials such as ferrites; or special deployment techniques. Such considerations often increase the cost of manufacture and maintenance making such systems generally expensive to operate and maintain. Furthermore, such systems may be less mechanically robust and may increase the possibility of equipment failure during deployment of operation underground. While travelling wave antennas may address some of the identified issues with respect to antenna design, they are typically excited from a single terminal. As a result, heating is concentrated close to that excitation terminal, which can increase the time required to heat the hydrocarbon formation or reservoir and reduces heating uniformity. In most systems, there is no way of increasing or decreasing power at a specific segment along the well. This may result in regions of excessive heating or insufficient heating, which increases operating cost.

Described herein is a radio frequency antenna which can be used in EM EOR processes as the radiator of EM energy into a heavy-oil formation. The antenna may also be used to heat bitumen and other hydrocarbon bearing formations or for environmental remediation. In particular, the described antenna comprises an excitation module with an electrically separated conductive sheath surrounding a portion of a conductive main member to define a coaxial line for guiding EM energy along the excitation module for deposition into the hydrocarbon formation. Each excitation module may operate as a travelling wave antenna that uses a single conductor for radiating or delivering the EM energy into the hydrocarbon formation. The structure of each excitation module can further function as an impedance matching circuit. Several excitation modules may be combined together in a modular manner to form larger irradiating structures. As such, the same excitation modules may be deployable into various types of hydrocarbon formations, into wells of various lengths and excitable at various frequencies. The antenna described herein can also be used with a distributed modular in-situ RF generator as described in U.S. patent application Ser. No. 14/508,423, or with a conventional RF generator located on the surface.

Structure of the Excitation Module

Figure 2A:
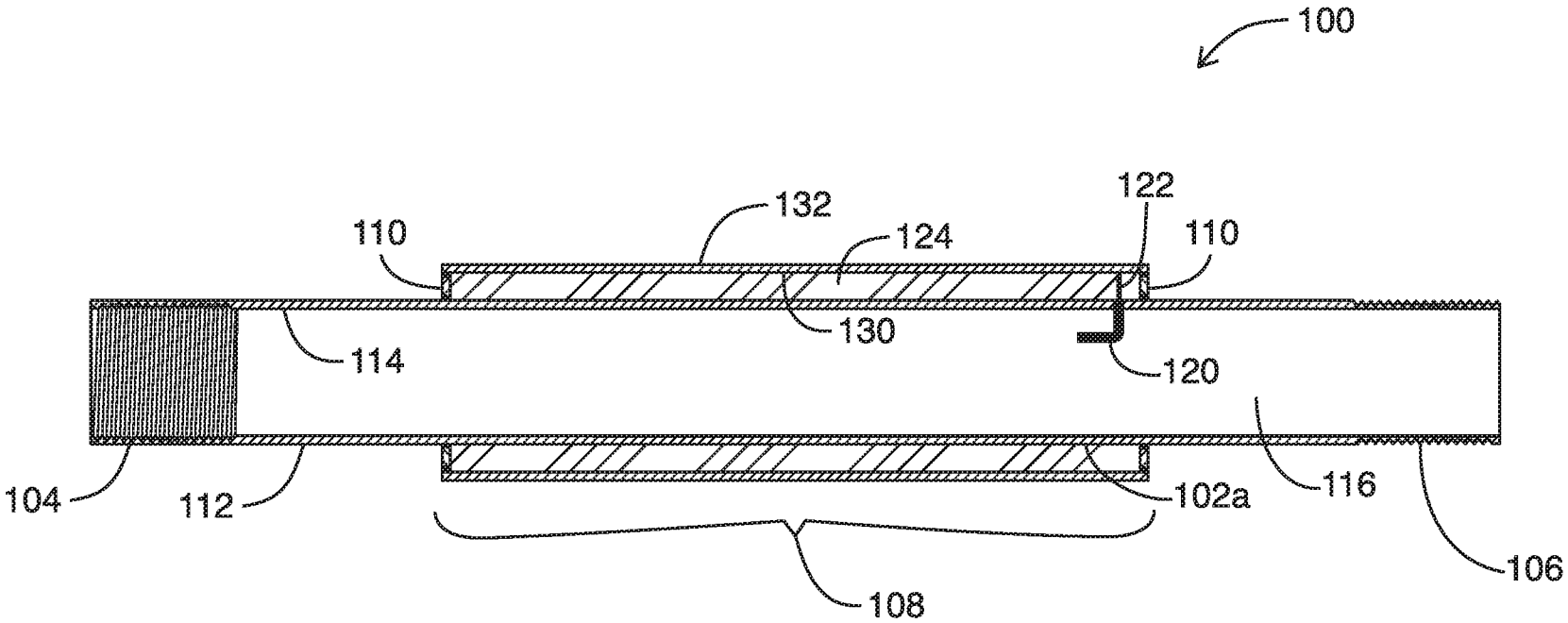
FIG. 2A is a longitudinal sectional view of the excitation module of FIG. 1 along a longitudinal axis according to at least one embodiment.

Referring to FIGS. 1 and 2A, shown therein is a perspective view and a sectional view along the longitudinal axis, respectively, of an excitation module 100 of the antenna for EM heating of a hydrocarbon formation according to at least one embodiment. As shown in FIG. 1 the module comprises a conductive member 102, a first connector 104, a second connector 106, a conductive sheath 108 of a particular physical length, seals 110, and feed connectors 122.

The conductive member 102 may be used to provide structural integrity to the module 100 and thus to the antenna and for providing the energy transfer into the hydrocarbon formation or reservoir by guiding an electromagnetic wave such as a travelling wave along its exterior.

In the present embodiment, as shown in FIGS. 1 and 2A, the main conductive member can be constructed using a rigid conductive pipe (hereinafter the "main pipe 102") that is hollow with a wall having an outer surface 112 and inner surface 114 that defines an interior 116.

The main pipe 102 can be fabricated using any appropriate conductive material including, but not limited to, aluminum, stainless steel, and carbon steel. It can also be built using composite materials, and may have a surface that's corrugated or cladded with other metals to achieve certain advantages. For example, in some embodiments, the main pipe 102 may be a carbon steel pipe cladded with aluminum. Such a pipe has higher mechanical strength than an aluminum pipe of the same dimensions, but can exhibit electrical conductivity of an aluminum pipe.

Figure 2B:
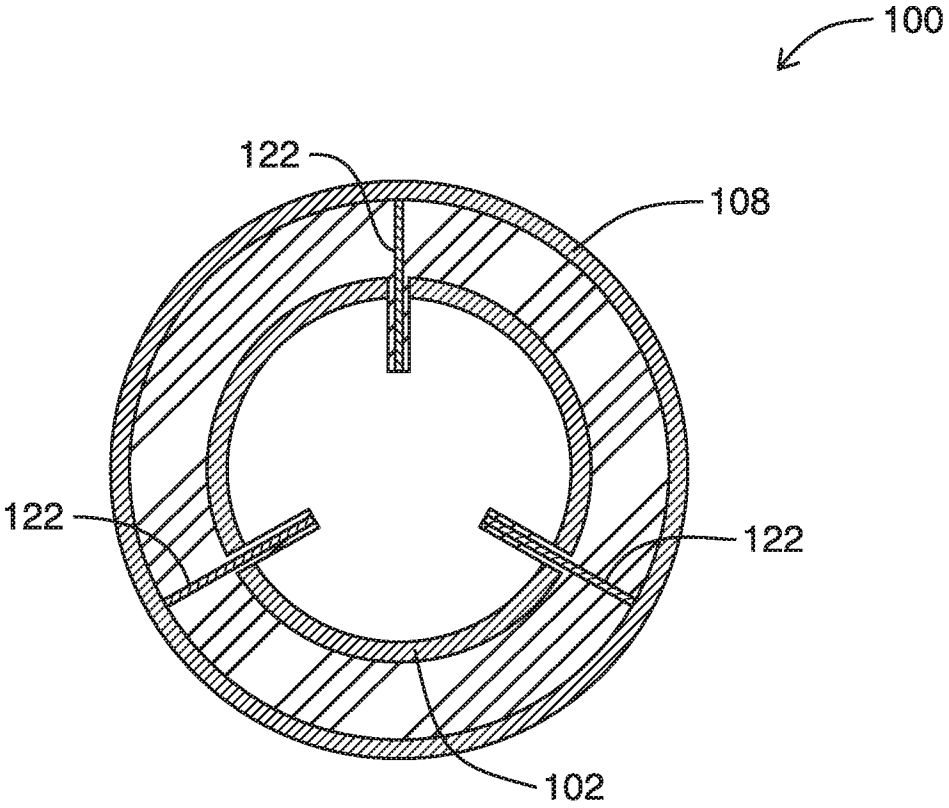
FIG. 2B is a transverse sectional view of the excitation module of FIG. 1 with azimuthally distributed feed connectors according to at least one embodiment.
Figure 3:
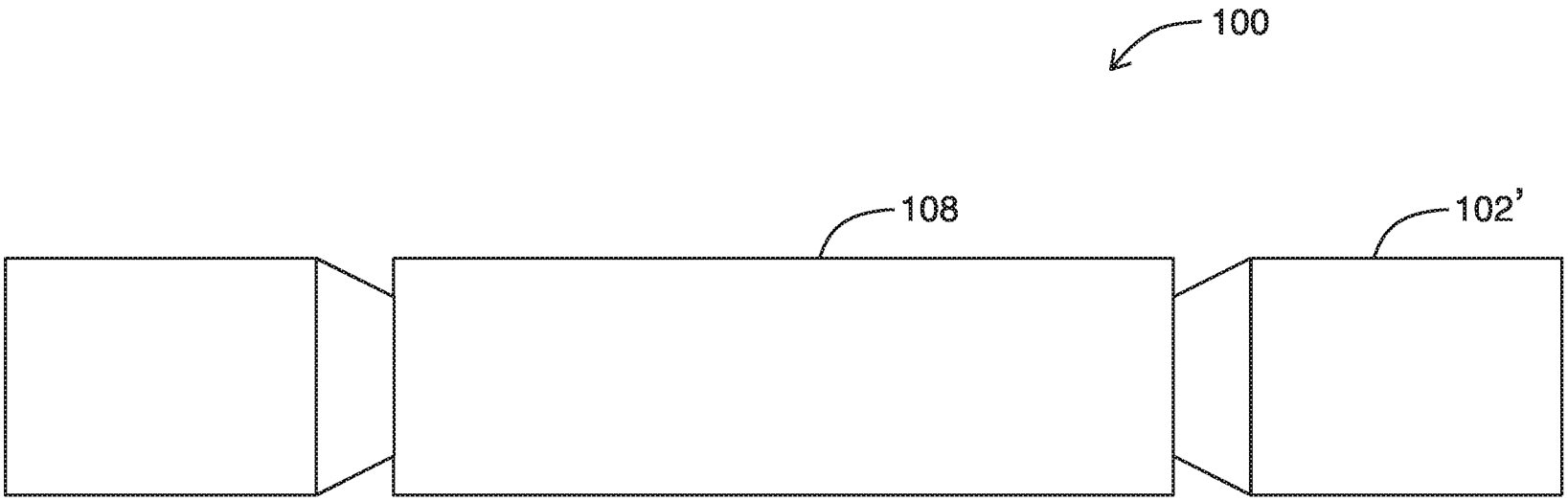
FIG. 3 is a diagram of an excitation module with radially flared main pipe portions according to at least one embodiment.

The cross-section of the main pipe 102 along a transverse axis can be, but is not limited to, circular as shown in FIG. 2B, rectangular, hexagonal, etc. The outer dimension of the main pipe 102 can range between 2 and 15 inches (between 5.08 cm and 38.1 cm). In some embodiments, however, the main pipe 102 need not have a constant diameter down its length. For example, the main pipe 102' as shown in FIG. 3 may flare radially once outside of the conductive sheath 108.

In some embodiments, the interior 116 of main pipe 102 may carry one or more AC or DC cables, control electronics, and other components of a distributed RF generator (not shown) provided with the main pipe. In some embodiments, feed transmission lines 120 can be used to carry RF power generated by RF power generation points located away from the main pipe 102 to electrical couplers located inside the main pipe 102. For example, the electrical couplers comprise of one or more module feed connectors 122 connected to the conductive sheath 108 as shown in FIG. 2B. The feed transmission lines 120 can be any suitable transmission line for carrying electrical power at the operating frequency and can include, but not limited to, single conductor cables or multi-conductor cables such as coaxial cables.

RF power generation points may be located at the surface, underground, or a combination of both. For example, if a surface RF generator is used, the RF power generation point is the surface RF generator itself and the feed transmission line 120, such as a coaxial cable, can carry the RF power from the surface to the module feed connectors 122. On the other hand, if an in-situ distributed RF generator is used, the RF power generation points may be located inside the main pipe 102, proximate to the module feed connectors 122. Therefore, a short section of the feed transmission line 120 such as coaxial cable may be needed to connect the power generation point and the module feed connector 122.

Referring still to FIGS. 1 and 2A, the first and second pipe connectors 104 and 106 can be located at first and second member end portions 104*a* and 106*a* of the main pipe 102, respectively. The type of connector can vary and may be, for example, a threaded connector (as shown in FIGS. 1 and 2A), clamp connector, or a combination of the two types of connectors. While a single excitation module can be used to operate as an antenna for radiating EM energy, the first and second pipe connectors 104 and 106 can be used to connect additional excitation modules together end-to-end as shown in FIG. 4 to extend the length of the antenna.

Figure 4A:
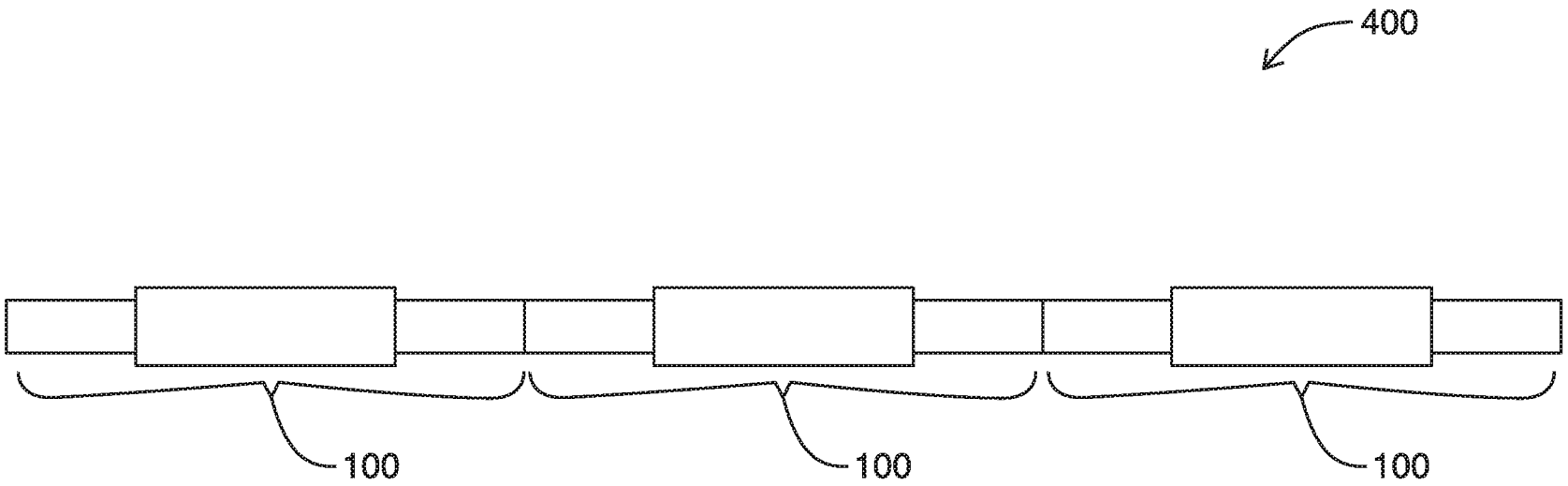
FIG. 4A is a diagram of an antenna comprising an excitation module chain according to at least one embodiment.
Figure 4B:
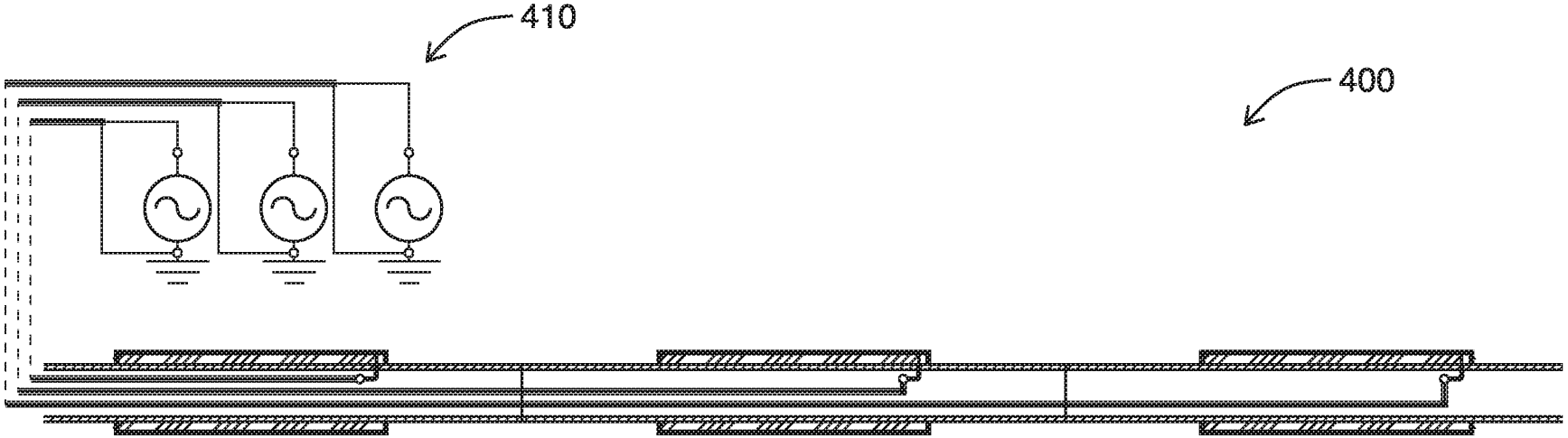
FIG. 4B is a diagram of the antenna of FIG. 4A with RF generators external to the modules according to at least one embodiment.
Figure 4C:
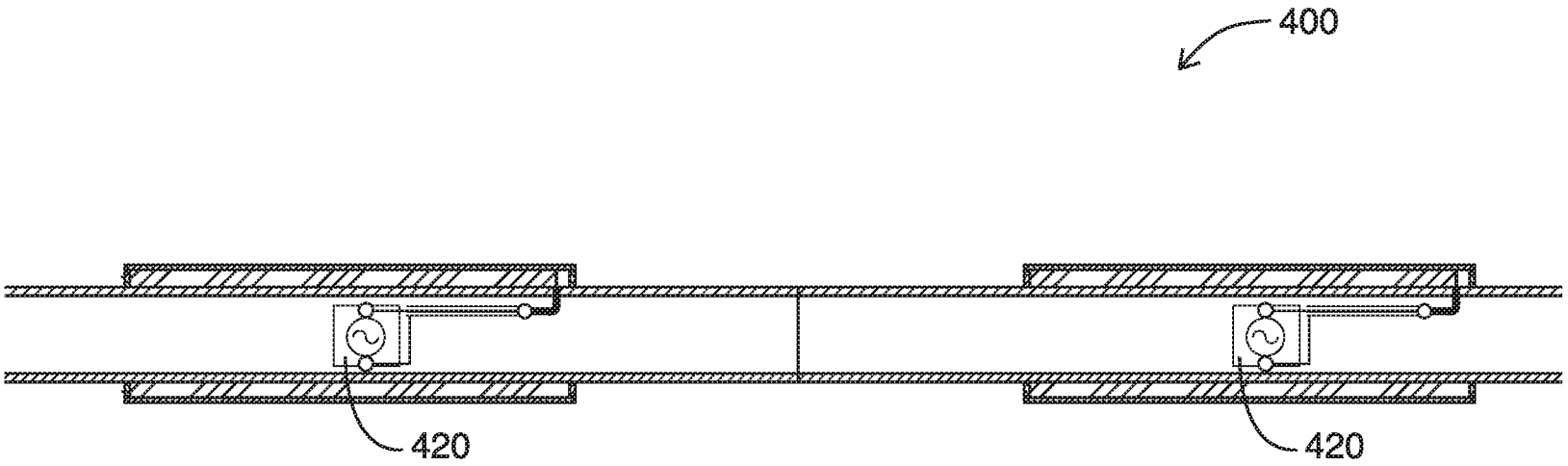
FIG. 4C is a diagram of the antenna of FIG. 4A with RF generators internal to the modules according to at least one embodiment.

The extended antenna comprising a number of excitation modules 100 connected end-to-end can be regarded as a module chain 400 as shown in FIG. 4. In such a case, the connectors are preferably conductive so that the module chain 400 comprises a contiguous conductive member. For example, the module chain 400 may be viewed as having one long "main pipe" (e.g. made up of several main pipes or pipes string 102 electrically connected end-to-end) with a number of conductive sheaths 108 distributed along its length. In some cases, excitation modules of different sizes (e.g. lengths of the main pipe 102 and/or conductive sheath 108, or diameter of the conductive sheath 108) may similarly be connected together to form the module chain 400. In other cases, all of the excitation modules are identical and are connected to form the module chain 400. RF generators used to excite the feed transmission lines of each module may be external to the modules or internal to each of the modules, and is similar to the configurations discussed in U.S. patent application Ser. No. 14/508,423. For example, RF generators 410 are external to the modules in FIG. 4B. In contrast, RF generators 420 are internal to the modules in FIG. 4C.

The module chain 400 can be connected to the RF generator to receive power to radiate EM energy into the hydrocarbon formation. In some embodiments, several of such module chains 400 may be deployed into the hydrocarbon formation. Where several module chains 400 are used, a group of module chains 400 may be formed. In some cases each module chain 400 may share the same RF generator or obtain EM energy from its own dedicated RF generator. In the latter case, a module chain in the group of module chains 400 can be operable to radiate independently of another module chain within the group. In yet other embodiments, each RF generator may operate at a different target frequency. Such configurations can be used to obtain the desired heating of the hydrocarbon formation.

It may be noted that while such configurations are described with respect to module chains, the same configurations may be applicable to individual excitation modules 100 (or combination of module chains and individual modules) being deployed into the hydrocarbon formation. For example, a number of excitation modules 100 can be individually deployed into a hydrocarbon formation to provide EM heating. A generator can be connected to one or a group of excitation modules 100 allowing the one module or group of modules 100 to irradiate EM waves into the hydrocarbon formation. In other cases several RF generators may be used to deliver EM energy to several corresponding excitation modules 100 or several groups of excitation modules 100. Each excitation module 100 or group of modules 100 can irradiate independently of each other. The frequency of irradiation may also vary depending on the configuration of the respective RF generator so that each excitation module 100 or group of modules 100 irradiate at a different frequency.

In some embodiments, it may be preferable for the first and second pipe connectors 104 and 106 to be sealed to impede or prohibit mixing of fluids such as the liquid or gaseous compounds located in the hydrocarbon formation and inside of the main pipe 102. This separation may be particularly relevant when different liquids or gasses, or the same liquid or gas, but of different purities, are located inside and outside of the main pipe 102.

In other embodiments, it may be preferable for the first and second pipe connectors 104 and 106 not be sealed. These types of connectors would generally be less expensive and easier to fabricate. Such connectors can be used in situations where the same liquid and/or gas are present inside and outside of the main pipe 102 so that their mixing would not interfere with operation of any components interior to the main pipe 116 via mechanical, chemical or electrical means.

The conductive sheath 108 with an inner conducting surface 130 and outer conducting surface 132 may be provided to surround or enclose a portion of the length of the main pipe 102 to operate as a waveguide structure to provide EM excitation and impedance matching to a variety of electrical environments, as will be described in further detail subsequently. Each section of main pipe 102 of the excitation module 100 has at least one conductive sheath 108. In some embodiments, the excitation module 100 can have two, three or more conductive sheaths distributed along its length. In other embodiments in which multiple conductive sheaths are present, the diameters of the sheaths may vary in size so that the diameter of one conductive sheath is different from the diameter of another conductive sheath.

According to one embodiment, the conductive sheath 108 as shown in FIG. 2A can be made to have a particular physical length with two ends. The sheath 108 can be fabricated using a metal pipe made of a conductive material including, but not limited, to aluminum, stainless steel, and carbon steel. In some cases the conductive sheath 108 can be made of a composite material such as fiberglass that is covered with a conductive material like metal or embedded with metal layers. Similar to the main pipe 102, the cross section of the conductive sheath may be, but is not limited to circular, rectangular, and hexagonal.

The inner diameter of the conductive sheath 108 is larger than the outer diameter of the main pipe 102. The conductive sheath 108 may be concentric to the main pipe 102. However in some embodiments, the conductive sheath 108 does not surround or enclose the main pipe 102 concentrically. It may be noted that a cavity 124 can be created between the conductive sheath 108 and the surrounded portion of main pipe 102. The existence of the cavity allows for electrically separating the conductive sheath 108 and the main pipe 102. Both ends of the conductive sheath 108 further define apertures, i.e. they are not electrically connected to the main pipe 102 using a metal or any other electrically conducting material. As shown in FIG. 2A, the conductive sheath can be connected to an RF source through the feed connector 122 using, for example, a metal post connected with the inner conductor of the coaxial feed transmission line 122.

Portions of the main pipe 102 surrounded by the conductive sheath 108, together with the material(s) provided in the cavity 124 therebetween, may define a length or segment of coaxial transmission line with an aperture at either end. In some embodiments, a dielectric material can be provided to fill the cavity 124. In other cases, several types of dielectric materials may be used. The dielectric material can be introduced to provide structural support for the excitation module 100 and/or to control the electrical properties such as the electrical length. Such dielectric material can include fluids (e.g. pressurized fluids), or one or more solid dielectric materials, or surface structures such as corrugations, or combinations thereof. Dielectric materials can be, but are not limited to ceramics such as alumina, zirconia, titanium dioxide, etc.; glass; quartz; or synthetic polymers such as PEEK, Teflon, polyethylene (PE), etc.; structural ceramics or other composite materials.

Figure 7A:
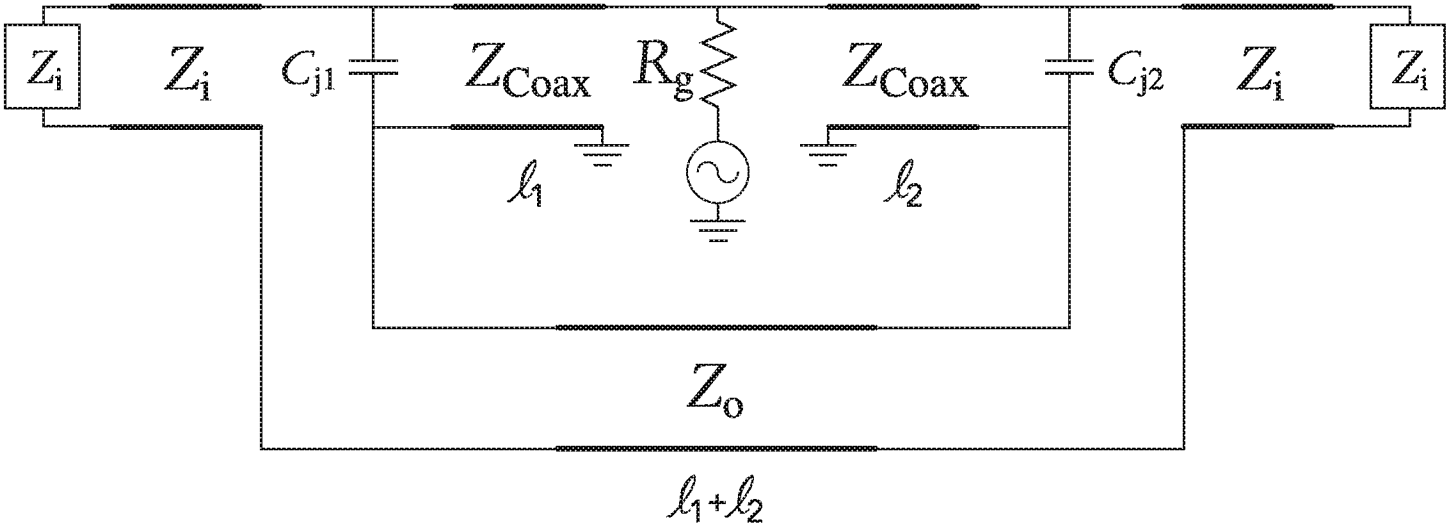
FIG. 7A is an equivalent circuit diagram of the excitation module of FIG. 1 according to at least one embodiment.
Figure 7B:
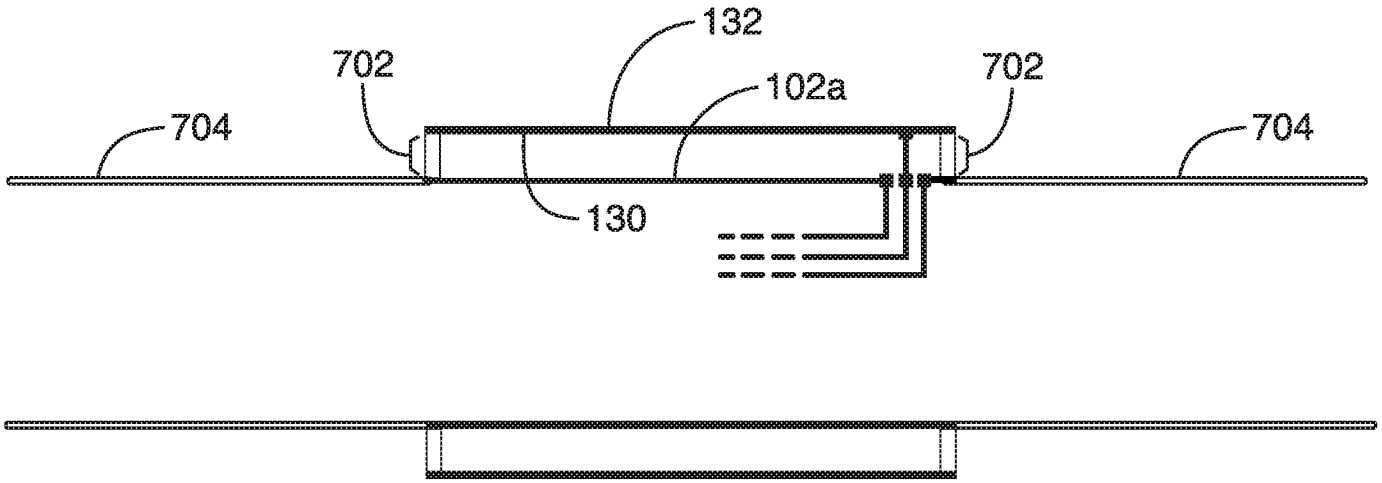
FIG. 7B is a schematic diagram of the excitation module of FIG. 1 according to at least one embodiment.

As shown in FIG. 2A, the surrounded portion 102*a* of the main pipe 102 may correspond to an inner conductor of the coaxial transmission line and the inner conducting surface 130 of the conductive sheath 108 may correspond to an outer conductor of the coaxial transmission line as shown in FIG. 7B. The EM field geometry created by this coaxial transmission line may be capable of exciting single conductor transmission lines and/or leaky transmission lines defined on the excitation module 100 as will be described in more detail below.

Impedance matching between the excitation module 100 and the surrounding hydrocarbon formation generally depends upon the electrical length of the coaxial transmission line defined by the conductive sheath 108 and the diameter of the main pipe 102. The physical length of the conductive sheath 108 can thus affect the electrical length. Selection of the physical length may depend upon the operating frequency, outer diameter of the main pipe 102, outer diameter of the conductive sheath 108, electrical parameters of the surrounding medium (e.g. the hydrocarbon formation) and the material provided in the cavity 124 between the main pipe and the conductive sheath. Details with respect to selecting the length of the conductive sheath shall be described in detail subsequently.

Electrical couplers can be used as a bridge for transferring EM energy from the feed transmission line 120 inside the main pipe 102 to the conductive sheath 108 as shown in FIG. 2A. An electrical coupler can comprise of one or a number of feed connectors 122. Each feed connector 122 can be connected to a single feed transmission line at a first feed connector port, and connected to at least one of the inner conductive surface 130 of the conductive sheath 108 and the inner surface 114 of the conductive pipe 102 at a second connector port. An example of a single feed connector 122 is provided in FIG. 2A. The feed connector 122 can be configured to electrically connect one conductor of a coaxial feed transmission line 120 to the conductive sheath and the other conductor to the main pipe 102.

Figure 2C:
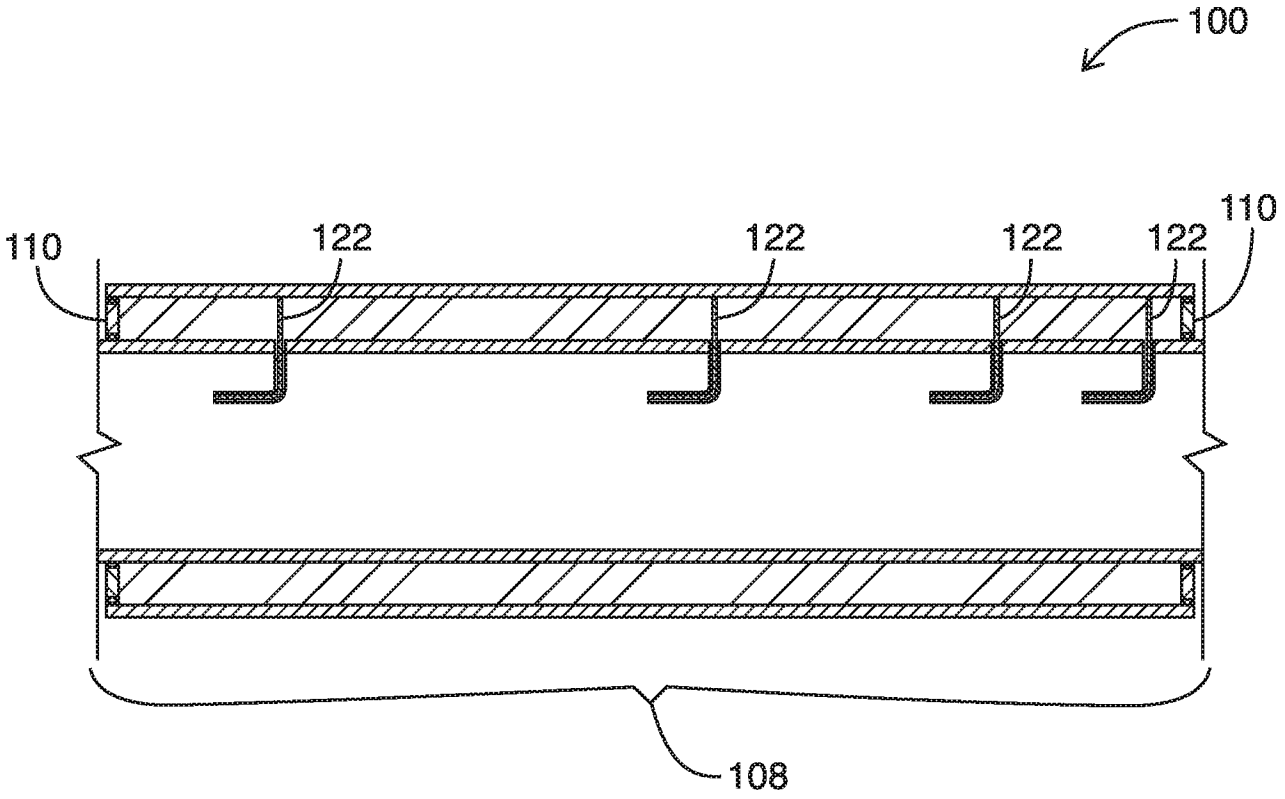
FIG. 2C is a longitudinal sectional view of the excitation module of FIG. 1 with axially distributed feed connectors according to at least one embodiment.

Generally, each module has at least one feed connector located along the length coaxial transmission line (i.e. between two ends of the conductive sheath 108). In some embodiments, the feed connector can be provided at one end of the length of coaxial transmission line. In other embodiments, the excitation module 100 can have one, two, three or more feed connectors 122 depending on the number of feed transmission lines or feed transmission line conductors. The feed connectors 122 can be distributed azimuthally or radially around the main pipe 102 as shown in FIG. 2B which shows a transverse cross-sectional view of the excitation module 100 with multiple feed connectors 122. Alternatively, the feed connectors 122 may be distributed axially or linearly along the length of the main pipe 102 inside the portion of the surrounded by the conductive sheath 108 as shown in FIG. 2C, or as a combination of the two arrangements.

Figure 2D:
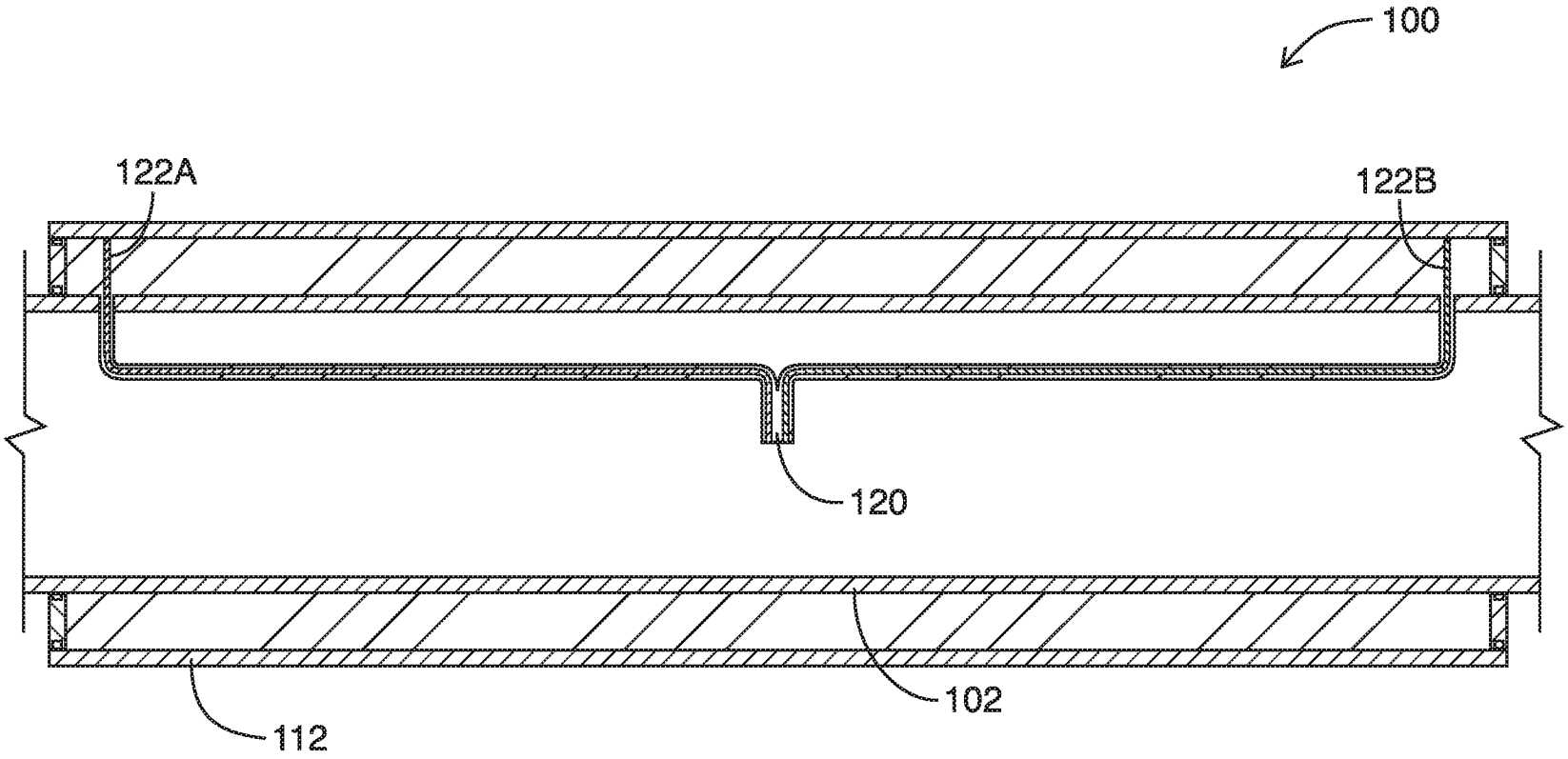
FIG. 2D is a longitudinal sectional view of the excitation module of FIG. 1 with multiple feed connectors connected to a single feed transmission line according to at least one embodiment.

In some embodiments, multiple feed connectors may be connected to a single feed transmission line, as shown FIG. 2D. First feed connector 122A and second feed connector 122B can be configured to electrically connect first and second conductors of the coaxial transmission line 120 to the conductive sheath 108.

The end portions of the coaxial transmission line defined by the main pipe 102 and conductive sheath 108, which interfaces with the hydrocarbon formation or reservoir, is preferably sealed structurally to separate the formation form the cavity 124. During use, if water, clay, drilling mud or other types of electrically conductive materials from the hydrocarbon formation or well reach the feed connector inside the cavity 124, a number of outcomes may arise, including i) formation of a short-circuit or near short-circuit of the feed point; ii) cause physical damage to the feed connector 122 by chemical or mechanical means; iii) modification of electrical properties or physical damage to electrical components on the interior 116 of the main pipe 102 (such as feed transmission lines, in-situ RF generators, etc.) by chemical or mechanical means.

Figure 5:
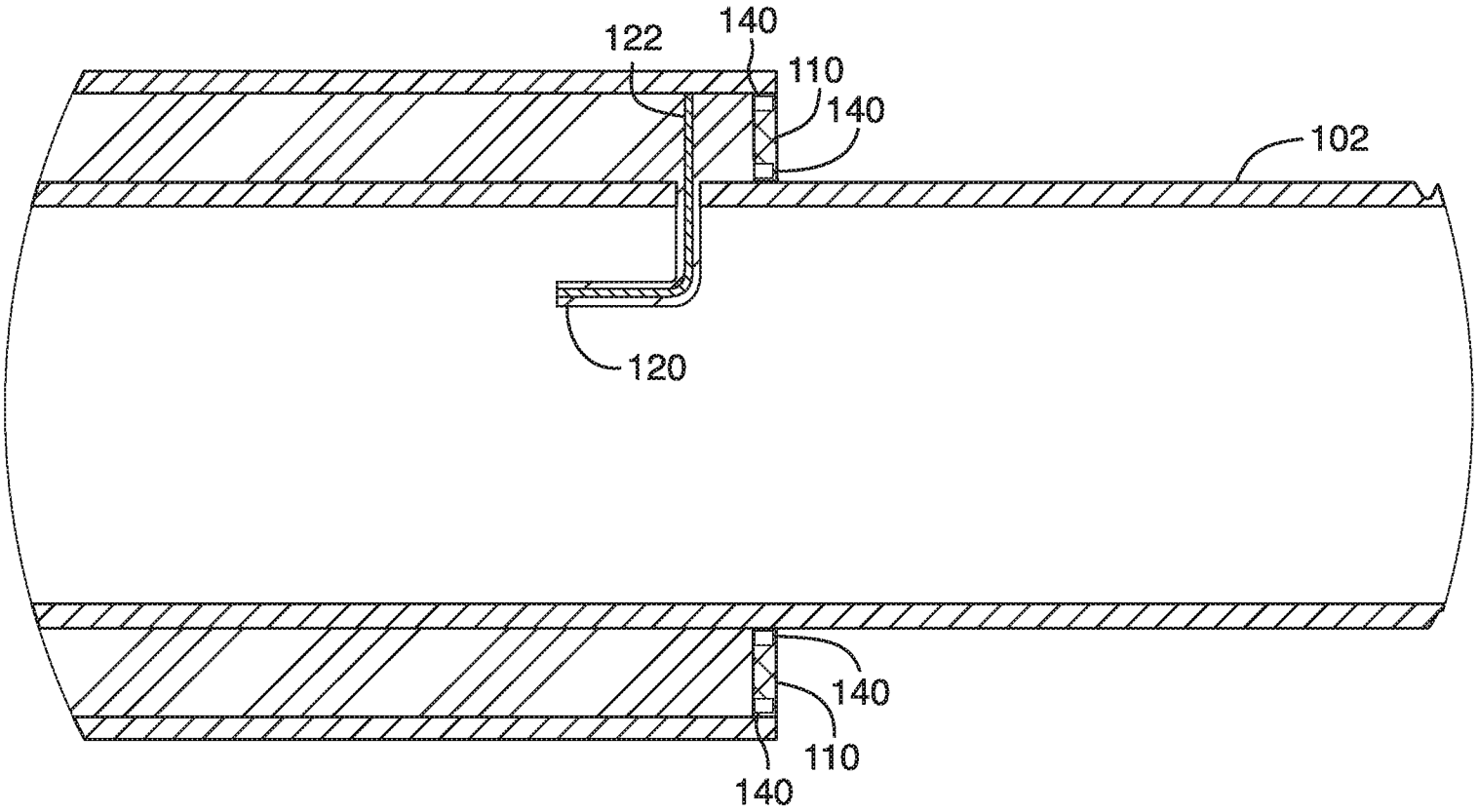
FIG. 5 is a diagram of one end of the coaxial line of the excitation module of FIG. 1 according to at least one embodiment.

These identified scenarios, alone or in combination, may cause a whole or significant part of the EM energy intended to be delivered to the hydrocarbon formation to be reflected by the feed connector back toward the RF generator or excessively heat the excitation module 100 or antenna. To avoid such undesirable outcomes, seals 110, as shown in FIG. 5, may preferably be disposed at the ends of the conductive sheath and used to maintain the cavity by physically sealing the cavity space to separate the feed connector from the hydrocarbon formation so that no materials from outside can reach the electrically sensitive area. In other words, an enclosed cavity can be defined by the surrounded portion of the main pipe 102, the conductive sheath 108 and the seals 110. As noted previously, this cavity is a part of the coaxial transmission line and may be filled with a dielectric material to control the electrical properties of the coaxial transmission line.

The seal is preferably made of materials which are electrically insulating, lossless or have low loss (loss tangent less than 0.01) at the frequency of operation; capable of withstanding high temperatures, such as 100° C., 200° C., 250° C., 300° C., or 500° C.; prohibits flow of fluids from the hydrocarbon formation and do not react chemically with the materials existing inside the well or formation, such as hydrocarbons, water, natural gas, drilling mud, etc. Suitable materials include, but not limited to, ceramics such as alumina, zirconia, titanium dioxide; synthetic polymers including, but not limited to, PEEK, Ultem™, Teflon™, Polyethilene and various elastomers (e.g. silicone). In some cases, a combination of one or more of such materials may be suitable materials for seals.

A cross sectional view of one end of the excitation module 100 showing an example of a feed connector seal 110 is presented in FIG. 5. In the embodiment presented, the seal 110 may have a torus of rectangular cross-section (toroidal shape) with an inner diameter equal to or slightly larger than the outer diameter of the main pipe 102, and an outer diameter equal to or slightly smaller than the inner diameter of the conductive sheath 108.

In some embodiments, inner and outer concentric structural rings such as O-rings 140 (two at each end), or, alternatively, tolerance rings, or combination thereof, can be used to allow for tolerance/variation in the fabrication of the seal 110 and conductive sheath 108 as well as to maintain the seal 110 in position when the dimensions of the various components such as the main pipe 102 and conductive sheath 108 change due to thermal expansion of the materials. The inner ring may be provided proximally to the conductive pipe 102 and the outer ring can be positioned proximal to the conductive sheath 108. Where O-rings 140 are used, the O-rings 140 are preferably made of materials with low electrical loss (e.g. loss tangent <0.01) and can withstand high temperatures such as 100° C., 200° C., 250° C., 300° C., or 500° C. Some examples of O-ring materials include, but not limited to, Viton™, Teflon™, nitrile, neoprene and Kalrez™. The actual shape of the seal generally does not have significant influence on the operation of the excitation module 100 if the seal thickness is smaller than 0.05 wavelengths.

EM Irradiation and Impedance Matching in the Initial State Operation

Figure 6:
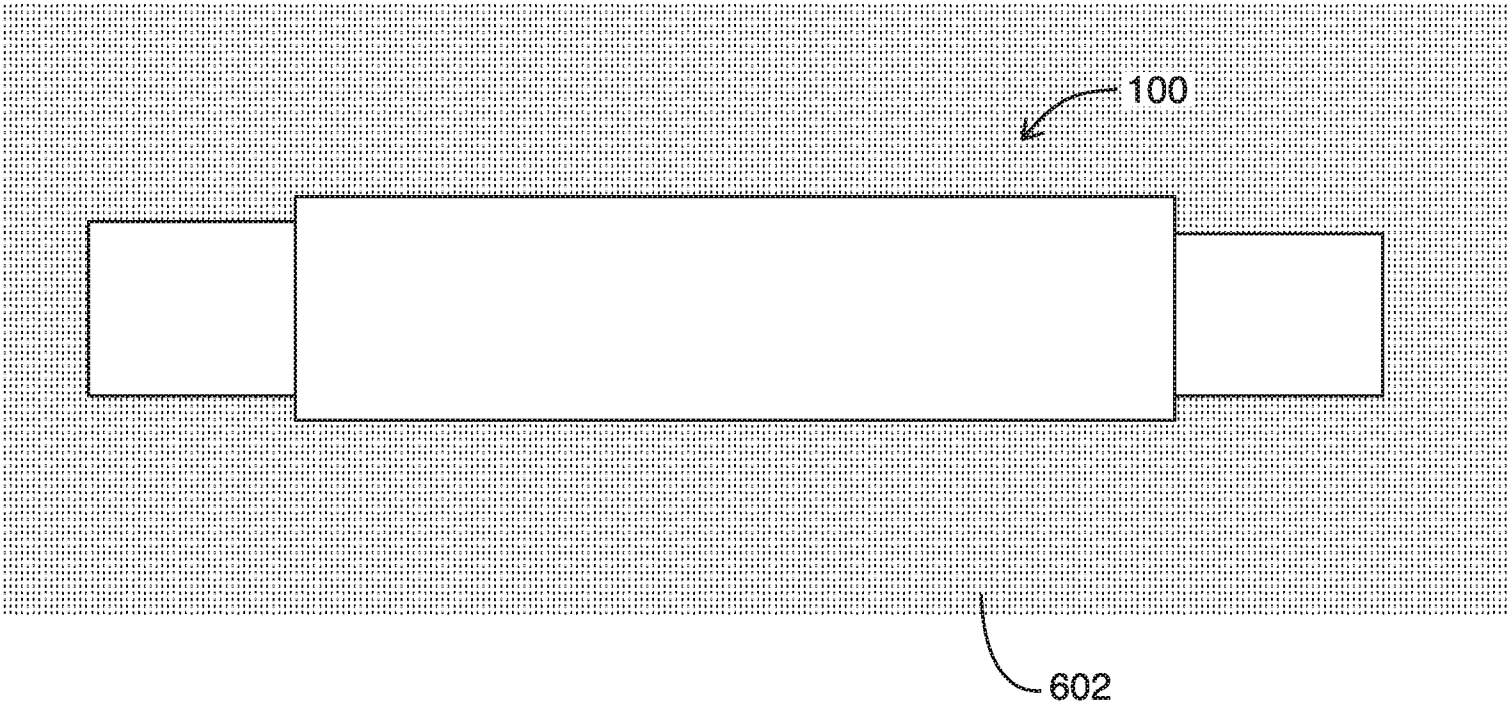
FIG. 6 is a diagram showing an antenna deployed within an unheated wet zone according to at least one embodiment.

One or more excitation modules 100 can be coupled to a generator and deployed into the hydrocarbon formation. Once an antenna comprising one or more excitation modules 100 has been deployed into the hydrocarbon formation, the generator can be operated to deliver EM power to the antenna. It can be assumed that the "Initial State" of each of the excitation module 100 is surrounded by an unheated, electrically conductive reservoir in what can be denoted as the "unheated wet zone" 602, as shown in FIG. 6. The aperture at the end of the coaxial transmission line can be used for exciting a travelling wave mode of EM propagation on a single conductor. Specifically, in the excitation module 100 described above, both the main pipe 102 and the outer surface of the conductive sheath 108 may be used as these single conductor transmission lines. It may be noted that these single conductor transmission lines are generally lossy, since they are enveloped by an electrically conductive medium (e.g. a hydrocarbon bearing formation with a saturation of water), where guided electromagnetic energy can be converted to heat in the reservoir. A detailed discussion of single conductor transmission lines in general may be found in [A. Sommerfeld, Lectures on Theoretical Physics, vol. 3, Academic Press, 1959.] and [J. A. Stratton, Electromagnetic Theory. John Wiley & Sons, 2007.].

Impedance matching to a variety of hydrocarbon formations or reservoirs with different electrical parameters may be achieved using these lossy single conductor transmission lines in conjunction with a selection of coaxial transmission line section length (i.e. length of the conductive sheath 108), coaxial transmission line characteristic impedance and placement of the feed connector 122 along the coaxial transmission line. Determination of the electrical length of the coaxial transmission line and placement of the connector will be discussed below.

To explain how impedance can be matched, allow, as an example, the physical length of the coaxial transmission line defined by the conductive sheath 108 and main pipe 102 be $l_1+l_2$, where the feed connector 122 is a distance $l_1$ from a far end of the section of coaxial transmission line and distance $l_2$ from a near end of the section of coaxial transmission line. If the operating wavelength is large compared to the outer radii of the main pipe 102 and conductive sheath 108 (the wavelength is >20 times whichever radius is largest), then the equivalent circuit of the corresponding antenna structure may be simplified to the circuit shown in FIG. 7A.

Specifically, the circuit of FIG. 7A is depicted from the point of view of the feed connector, where a generator with system impedance $R_g$, represents the applied signal (i.e. the EM wave). The generator can "see" the far and near ends of the coaxial transmission line section through two different lengths of the coaxial section, which has characteristic impedance $Z_{Coax}$.

At each end of the coaxial section, an effective shunt capacitance can be considered, which can result from the fringing fields at this transmission line discontinuity 702 as shown in FIG. 7B. Calculation of this capacitance can be found in [N. Marcuvitz, Waveguide Handbook. McGraw-Hill, 1951.]. Beyond the capacitance, there exist two single conductor transmission lines sharing the same ground reference. Referring to again FIG. 7B, the inner conductor of the coaxial section 102*a* connects with a single conductor transmission line formed by portions of the main pipe 102 that are not enclosed by the conducting sheath 108. This single conductor transmission line can be referred to as the inner single conductor transmission line 704, which has characteristic impedance Z as shown in FIG. 7A. For simplicity, the main pipe 102 can be considered to be infinitely long such that this inner single conductor transmission line 704 is matched. In the final design stage, where the single conductor transmission line need be modelled as finite, e.g. when a reflection from the end of the main pipe need be considered, the impedance terminating the single conductor line should be an equivalent representation of this reflection, and would typically be determined from computer simulations. In cases where several conductive sheaths are present along the main pipe, several of such inner single conductor transmission lines 704 may be present and the circuit model in the circuit of FIG. 7A may be modified.

The outer conductor of the coaxial section, in other words, the inner surface 130 of the conductive sheath 108, connects with the outer surface 132 of the conductive sheath, the latter forming another single conductor transmission line. This other single conductor transmission line can be referred to as the outer single conductor transmission line 132, which has characteristic impedance $Z_o$ as shown in FIG. 7A. The inner and outer single conductor transmission lines of the present embodiment can be said to be separated by the electrical discontinuity 702. It can be noted that the capacitance and the characteristic impedances of the inner and outer single conductor transmission lines can depend upon the electrical size of the structure of the excitation module (e.g. the sheath 108) and the electrical properties of the surrounding medium.

Figure 7C:
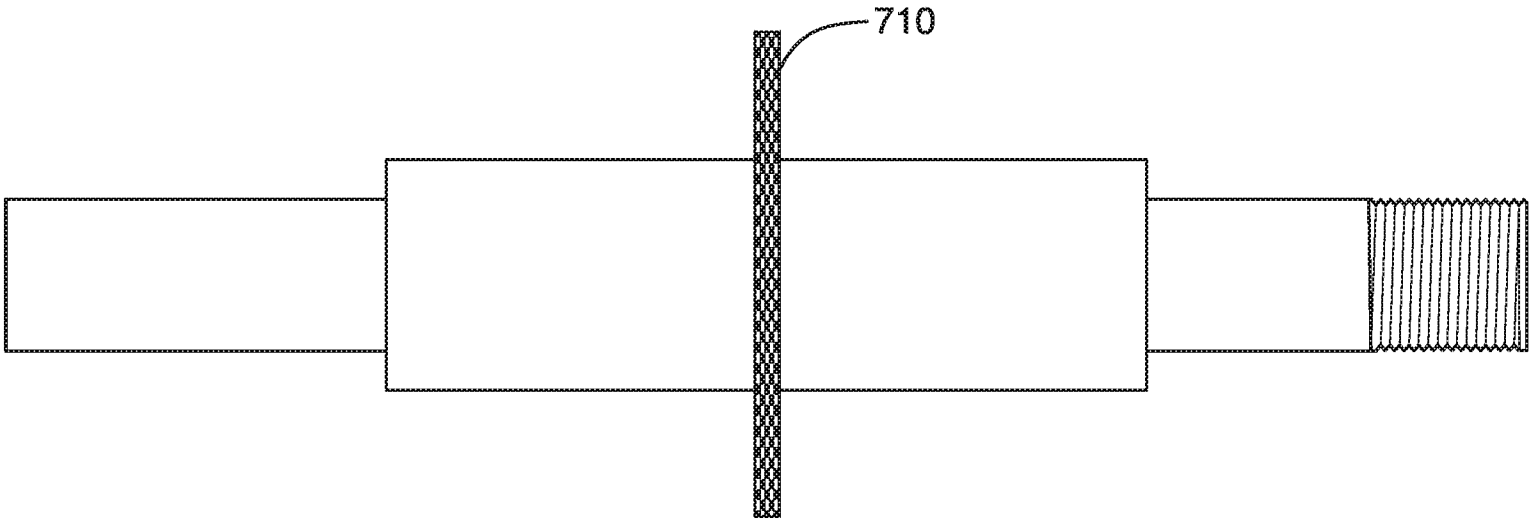
FIG. 7C is a diagram indicating the location of the Perfect Electric Boundary Condition of a half-wavelength conductive sheath according to at least one embodiment.

With reference to the circuit of FIG. 7A, the two lengths of coaxial transmission line seen by the feed connector ($l_1$ and $l_2$) are coupled with the total length of the outer single conductor transmission line ($l_1+l_2$). The capacitances ($C_{j1}$ and $C_{j2}$) and the characteristic impedances ($Z_i$, $Z_o$, and $Z_{coax}$) are all coupled, and depend upon the frequency of operation, radii of the conductive sheath, the radius of the main pipe and the reservoir electrical characteristics. To aid in the explanation of operation, a usage case is presented in which the conductive sheath has a length that is half wavelength (relative to the guided wavelength inside the coaxial section) or substantially half wavelength (e.g. ranging between 40% to 60% of the guided wavelength inside the coaxial section) of the irradiation frequency and in which the feed connector 122 is placed close to one or both ends of the coaxial section can be considered. When the coaxial transmission line is chosen to have an electrical length of half or substantially half wavelength with the feed connector position close to one end of the coaxial section, the EM fields at either end of the coaxial transmission line would be about 180 degrees out of phase (in the case of two feed connectors at either end of the coaxial section, the signals applied to each end will need to be 180 degrees out of phase). In turn, the nature of the fields can impose a virtual perfect electric conductor (PEC) boundary condition 710 in the transverse mid-plane surrounding the antenna structure (i.e. at the mid-point of the length of coaxial transmission line), as shown in FIG. 7C.

Figure 8:
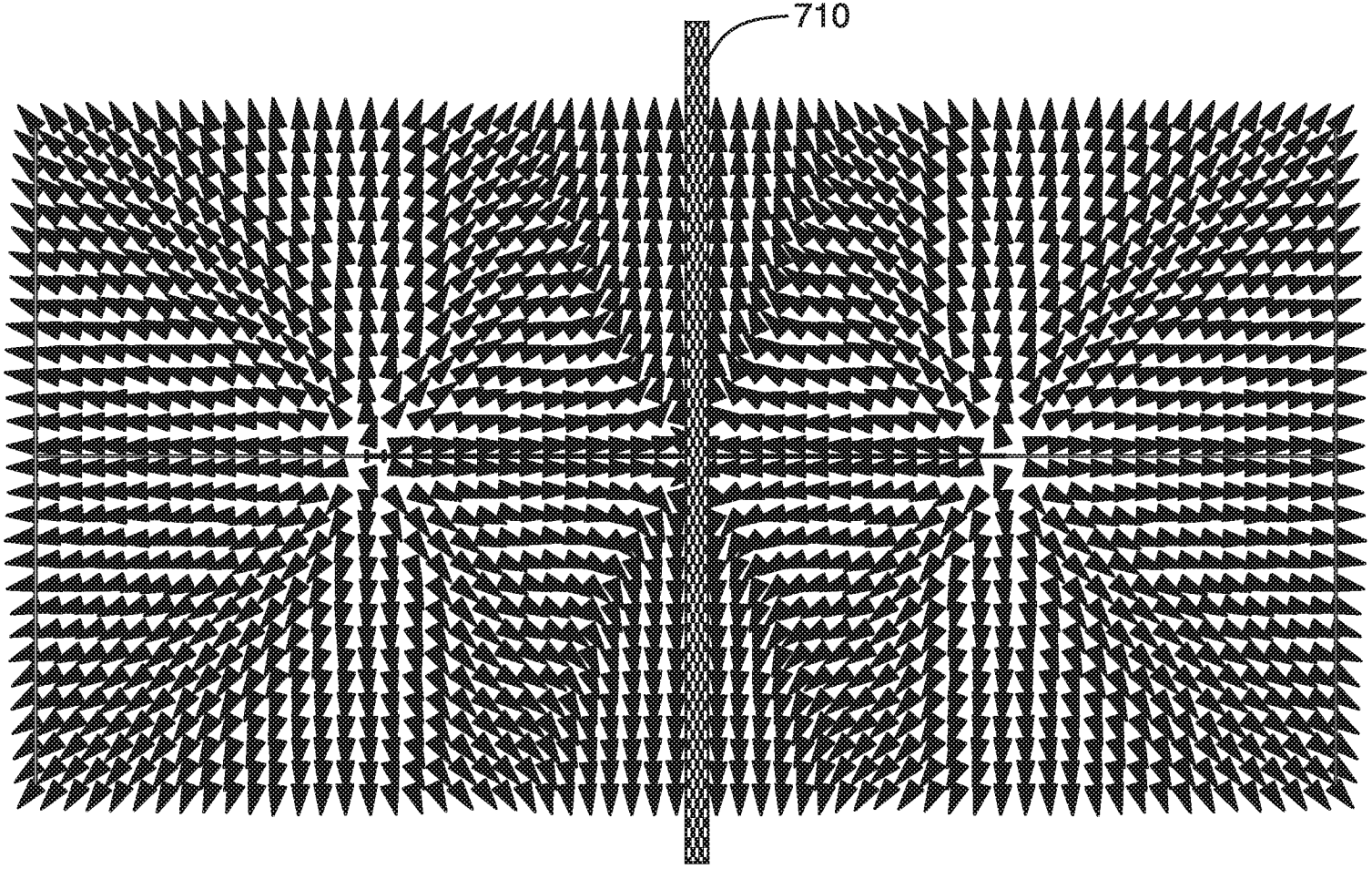
FIG. 8 is a diagram indicating Poynting vectors inside the antenna structure of FIG. 7C indicating the Perfect Electric Boundary Condition according to at least one embodiment.

In some cases, one or more feed connectors 122 may be positioned near the midpoint position to provide EM power to the excitation module. FIG. 8 shows the directions of the Poynting vector outside this antenna structure, indicating the presence of a PEC boundary 710. In the case of a module chain, this model is applicable in the initial state only, assuming adjacent models do not influence each other, in cases where the fields are largely absorbed by the reservoir before reaching neighboring modules. In other cases e.g. periodic system analysis, or other system simulations are performed numerically.

Figure 9:
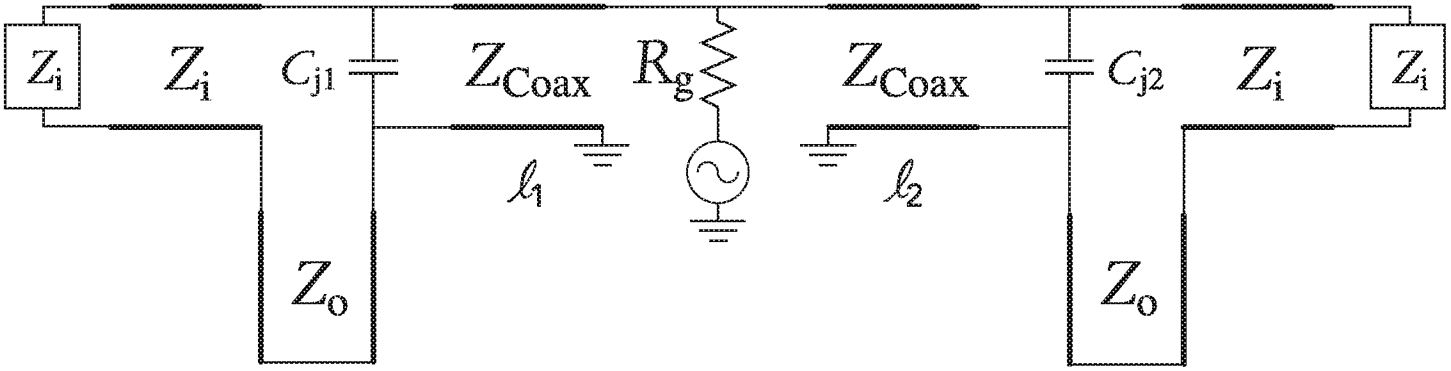
FIG. 9 is an equivalent circuit diagram of an excitation module of with the Perfect Electric Boundary Condition of FIG. 7C according to at least one embodiment.

This virtual PEC boundary 710 can be modeled by splitting the outer single conductor transmission line shown in FIG. 7A into two lossy short-circuited stubs with impedance $Z_o$, as shown in FIG. 9. In this configuration the operation of the structure may be observed more intuitively: the shorted stubs add an additional degree of freedom that can assist with impedance matching the electromagnetic wave at the feed connector of the antenna structure moving to the inner single conductor transmission line with characteristic impedance $Z_i$. This determines how to select the required module dimensions (determining $C_{j1}$ and $C_{j2}$, $Z_i$, $Z_o$ and $Z_{Coax}$) for a specific operating frequency and expected reservoir conditions. Again, this PEC boundary, feed connector position and the selection of a half wavelength conductive sheath is for illustration purposes and the electrical length in use can be greater or less than a half wavelength. In the event the designer cannot find module dimensions that are satisfactory, the feed connector position and conductive sheath length needs to be adjusted and the process repeated. Generally, an arbitrary virtual impedance boundary would be present at or near the mid-plane surrounding the antenna structure with a conductive sheath of any length or feed connector position.

In some embodiments, when the coaxial transmission line is chosen to have an electrical length of half or substantially half wavelength of the irradiation frequency with one feed connector near the midpoint of the coaxial transmission line or two feed connectors near both ends of the coaxial transmission line, a perfect magnetic conductor (PMC) boundary condition using magnetic field symmetry can be formed if the magnetic fields from either end arrive at the midpoint of the conductive sheath out of phase (in the case of two feed connectors at either end of the coaxial section, the signals applied to each end will need to be in phase). The PMC boundary condition may also be located in a transverse mid-plane of the coaxial transmission line that is transverse to the main axis of the antenna structure.

In yet other embodiments, the length of the coaxial transmission line can be chosen such that it is an odd multiple of one half of the wavelength of the oscillation frequency of the EM energy.

The physical length of the coaxial transmission line can be affected by at least one of: the target frequency; outer diameter of the main pipe 102; outer diameter of the conductive sheath 108; the material occupying the cavity 124; and the electrical characteristics of the hydrocarbon formation. Having regard to the identified factors in consideration, a selection of structural dimensions of the excitation module can be made so that the resultant antenna can be electrically matched to a broad range of external media, or to media which undergo changes in its physical or electrical properties over the course of heating.

Figure 10:
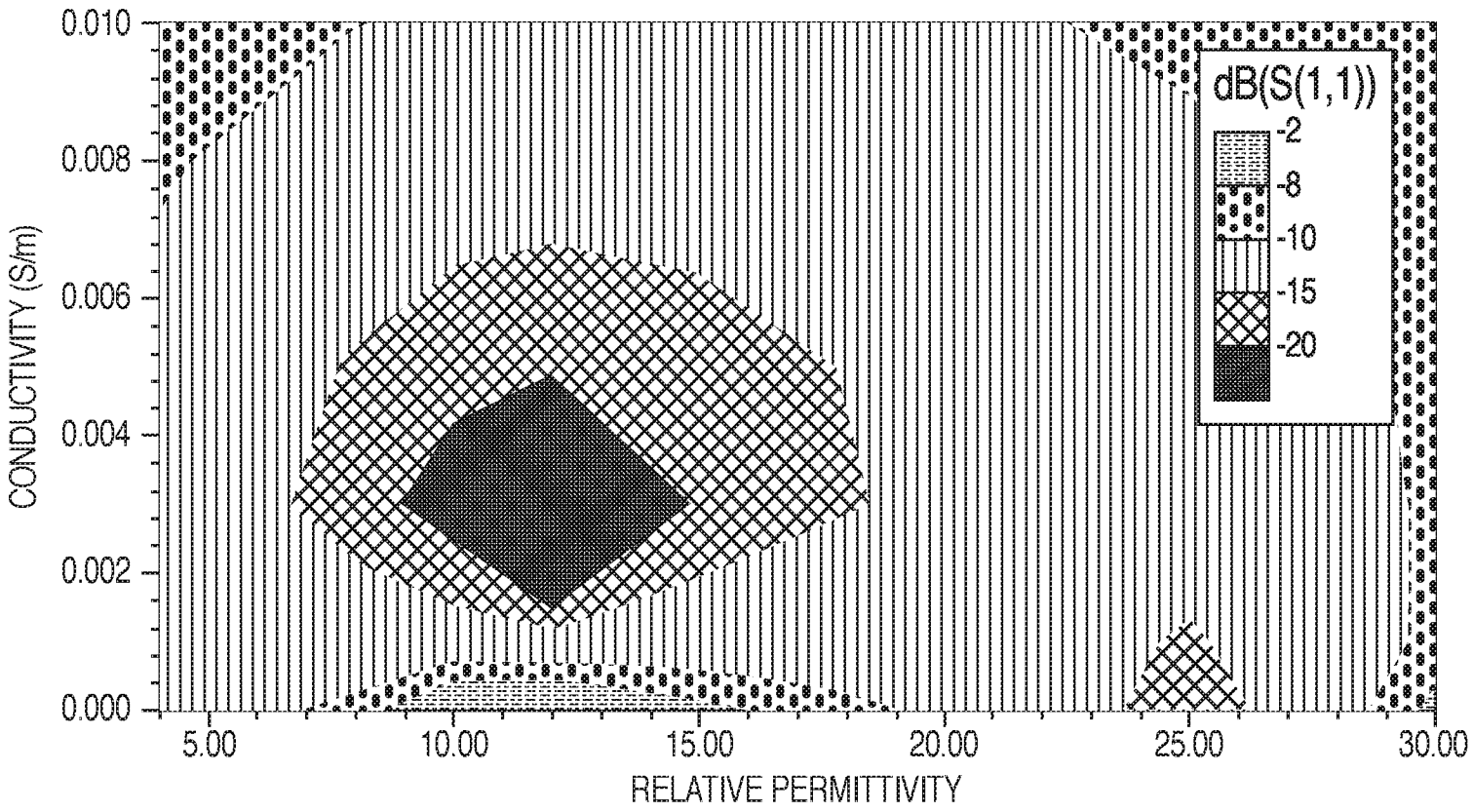
FIG. 10 is a plot of scattering parameter S11 versus electrical conductivity and relative permittivity of medium surrounding an excitation module having the equivalent circuit of FIG. 9 according to at least one embodiment.

Returning back to the half wavelength conductive sheath antenna structure as an example once more, this configuration may be regarded as the structure having physical dimensions and characteristic impedances being optimized for a certain operating frequency. The reflection coefficient seen by a generator, in the form of the scattering parameter $S_{11}$, is plotted versus the external medium's electrical conductivity and relative permittivity in FIG. 10. The values of electrical conductivity and relative permittivity are based upon the experimental results in [F. S. Chute, F. E. Vermeulen, M. R. Cervenan, and F. J. McVea, "Electrical Properties of Athabasca Oil Sands," Can. J. Earth Sci., vol. 16, pp. 2009-2021, 1979.]. An $S_{11}$ parameter less than or equal to −10 dB indicates that the structure matches the impedance of the external medium for most test cases. Note that the impedance match is only lost for cases along the periphery of the test space. This impedance robustness can be attributed to how the characteristic impedance of both single conductor transmission lines and discontinuity capacitance changes with permittivity and conductivity of the external medium.

Semi Steady-State Operation

Electromagnetic heating can be regarded to have reached a semi steady-state of operation when the hydrocarbon formation or reservoir volume immediately adjacent to the radiating source (e.g. excitation module 100, irradiating modules, or module chain(s)) has been heated along the length of the main pipe 102 and along the length of the conductive sheath 108 to a point where water within the pore spaces of the hydrocarbon formation or reservoir has evaporated. These evaporated zones that surround the excitation module can be called "dry-out" zones. Both the dielectric constant and electrical conductivity of the dry-out zones are generally lower than the unheated volumes of the hydrocarbon formation or reservoir.

Measurements of oil sand permittivity and conductivity as a function of water saturation can be found in [F. S. Chute, F. E. Vermeulen, M. R. Cervenan, and F. J. McVea, "Electrical Properties of Athabasca Oil Sands," Can. J. Earth Sci., vol. 16, pp. 2009-2021, 1979.]. The exact difference in electrical properties between unheated and heated zones varies reservoir to reservoir, but, as a rough example at 1 MHz based on the cited study, the permittivity and conductivity may change from about 30 and 0.02 S/m to about 10 and 0.0001 S/m. It may be noted that semi steady-state conditions is not signaled or indicated by a specific dry-out zone size, but rather, it can be achieved when the dry-out zone is present everywhere around the antenna. Furthermore, this state of operation is regarded as a "semi steady-state" since the volume of the dry-out zone is increasing as the heating process advances.

Figure 11:
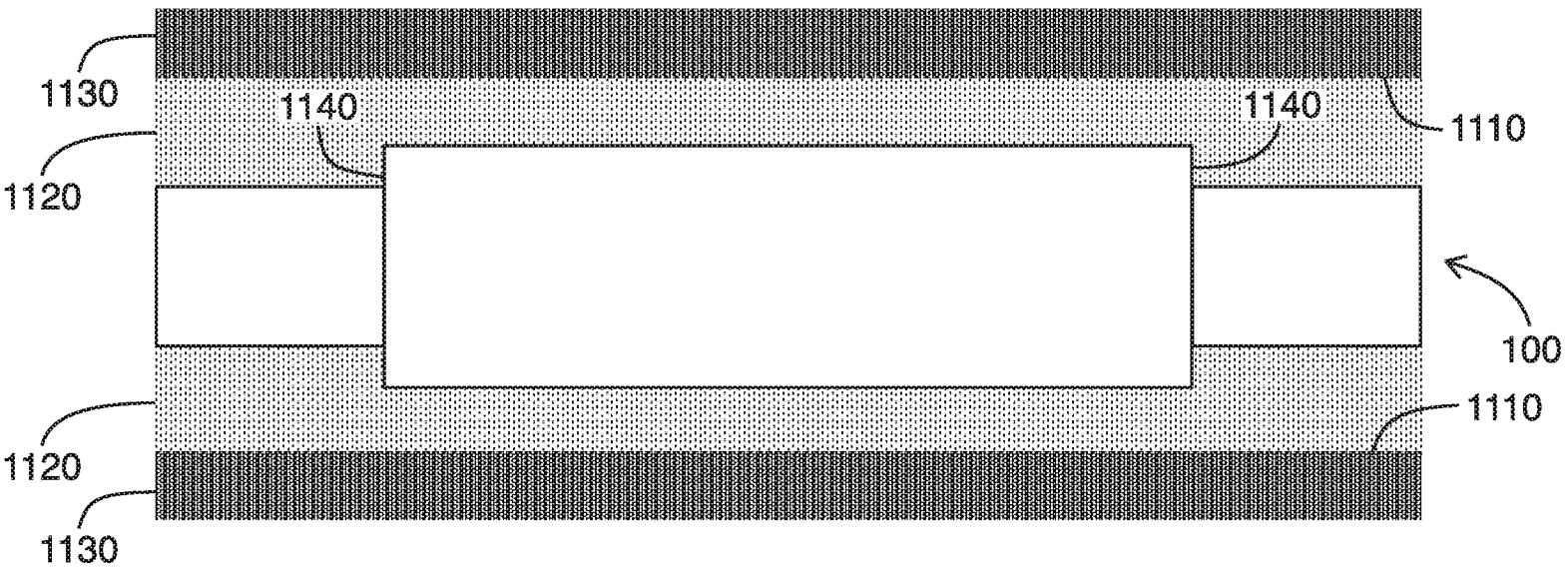
FIG. 11 is a diagram of an excitation module in semi steady-state operation according to at least one embodiment.
Figure 12:
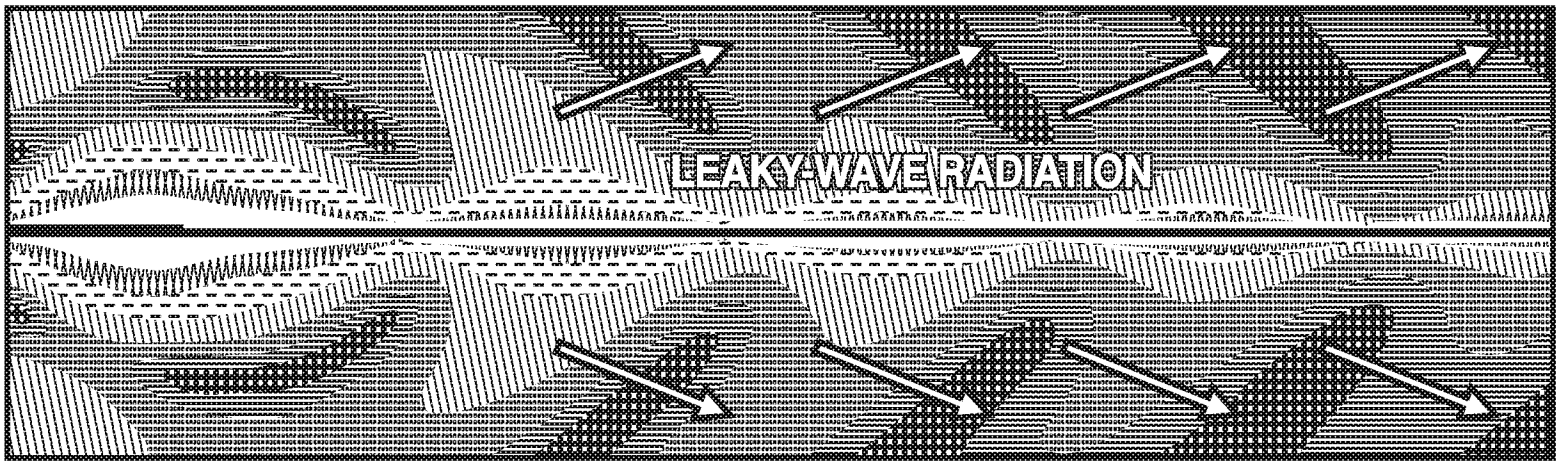
FIG. 12 is a diagram of the radiation pattern of a leaky-wave radiator according to at least one embodiment.

Formation of the dry-out zone can create lossy coaxial transmission lines defined along the main pipe and along the outer surface of the conductive sheath of an excitation module as shown in FIG. 11. For each excitation module 100 (or alternatively, chain(s) of modules) the effective outer conductors of these transmission lines can be the boundary 1110 between the low and high electrical conductivity regions corresponding to the heated dry-out zone 1120 and unheated wet zone 1130 of the hydrocarbon formation or reservoir, respectively. The inner conductor of the lossy coaxial transmission lines may be defined by the portions of the main pipe 102 that are not surrounded by the conductive sheath 108 (i.e. the inner single conductor transmission line) and the outer surface of the conductive sheath 108 (i.e. the outer single conductor transmission line). Since the outer conductors of these "dry-out coaxial transmission" lines are defined by the boundaries of a medium with a higher dielectric constant (i.e the unheated wet zone 1130), the structure can behave as a uniform leaky-wave radiator. An example of a radiation pattern of leaky wave radiation from one end of the sheath coaxial line is shown in FIG. 12. This leaky-wave radiation can continue heating the hydrocarbon formation or reservoir outside the dry-out zone 1120, and the dry-out zone can slowly expand with time as more heat is deposited.

Once the semi steady-state of operation is reached, impedance matching can become easier since the apertures 1140 of the conductive sheath are surrounded by the dry-out zone 1120. The operation of the excitation module in the semi steady-state can be described again by considering an example case where the coaxial transmission line formed by the conductive sheath and the main pipe is one half of the operating wavelength. The initial state circuit model as shown in FIG. 9 may be applied to an isolated module in the semi steady-state since the perfect electric conductor boundary condition at the conductive sheath's transverse mid-plane (FIGS. 7C and 8) and additional capacitance from fringing fields at the transmission line discontinuity are still present. Note the if this model is reapplied, the single conductor transmission lines are replaced by the dry-out coaxial transmission lines. Because the fringing fields exist predominately inside the dry-out zone 1120 with a generally consistent dielectric constant, the capacitance in the circuit model may have a small dependence on the dielectric constant of the unheated reservoir. In turn, the input impedance of the resultant circuit may stabilize, and impedance matching can become less of a concern once a dry-out zone has formed.

In some embodiments where several modules are connected together underground in a modular deployment, the dry-out zones surrounding each coaxial transmission line may connect, forming a longer uniform leaky-wave antenna with distributed sources. The power and phase of the EM energy of each module source may be controlled to obtain an overall heating pattern along the hydrocarbon formation or well, as suggested in U.S. patent application Ser. No. 14/508,423. For example, multiple excitation modules 100 or module chains 400 may be irradiating EM waves having the same phase. Alternatively, one or more modules may be configured to irradiate EM waves that are out of phase (e.g. 180 degrees out of phase or some other phase relationship).

The emitted EM waves may generate a desired irradiation pattern as a result of constructive and destructive interference thereof. For example, if one area of the hydrocarbon formation is being underheated or overheated, the power and/or phases of the nearest modules can be configured to correct the heating of the problem region. In general, adjusting phases and power levels of modules provides new means of establishing and controlling radiation patterns of the distributed antenna (as taught in U.S. patent application Ser. No. 14/508,423).

Numerous specific details are set forth herein in order to provide a thorough understanding of the exemplary embodiments described herein. However, it will be understood by those of ordinary skill in the art that these embodiments may be practiced without these specific details. In other instances, well-known methods, procedures and components have not been described in detail so as not to obscure the description of the embodiments. Furthermore, this description is not to be considered as limiting the scope of these embodiments in any way, but rather as merely describing the implementation of these various embodiments.

The invention claimed is:

1. A radio frequency antenna module in a radio frequency antenna for delivering electromagnetic energy generated by a generator into a hydrocarbon formation, the antenna module comprising:

a conductive member defined by a hollow pipe;

at least one conductive sheath with a first and second end surrounding at least one portion of the conductive member;

at least one feed transmission line extending within the pipe that delivers the electromagnetic energy to the antenna module;

at least one feed connector disposed within the pipe, each feed connector electrically connected to:

i) one of the at least one feed transmission line at a first feed connector port; and ii) at a second connector port, at least one of a) an inner conducting surface of the pipe and b) an inner conducting surface of one of the at least one conductive sheath; and an electrically insulating seal inserted at the first and second end of each of the at least one conductive sheath between the conductive member and the conductive sheath to maintain an enclosed cavity defined by the conductive member, the conductive sheath and the electrically insulating seal for electrically separating the conductive member and the conductive sheath.

2. The antenna module of claim 1, wherein the electromagnetic energy radiates with a frequency between 1 kHz and 100 MHz.

3. The antenna module of claim 1, wherein the antenna module comprises at least one irradiating module, each irradiating module comprising one of the at least one conductive sheath and one portion of the conducive member, each irradiating module comprising a first and second connector located at a first member end and a second member end of the respective portion of the conductive member, such that a plurality of irradiating modules are connectable to form at least one module chain.

4. The antenna module of claim 3, wherein the first and second connector are electrically conductive such that each of the at least one module chain comprises a contiguous conductive member.

5. The antenna module of claim 3, wherein the antenna module comprises a plurality of module chains such that a first module chain set is configured to radiate independently of another module chain set.

6. The antenna module of claim 5, wherein the first module chain set radiates at a first target frequency and the other module chain set radiates at a second target frequency.

7. The antenna module of claim 3, wherein each of the first and second connector provides a sealed connection that prohibits flow of fluids from the hydrocarbon formation into the pipe.

8. The antenna module of claim 1, wherein the at least one conductive sheath comprises an outer conducting surface; and for each of the at least one conductive sheath, a segment of coaxial transmission line having an inner and outer conductor is defined by that conductive sheath and a corresponding surrounded portion of the conductive member such that the outer conductor comprises the inner conducting surface of that conductive sheath and the inner conductor comprises the corresponding portion of the conductive member surrounded by that conductive sheath.

9. The antenna module of claim 8, wherein the at least one conductive sheath comprises a plurality of conductive sheaths, and wherein a first sheath has a diameter that is different from at least one other conductive sheath.

10. The antenna module of claim 9, further comprising:

a second coaxial transmission line comprising:

i) a second inner conductor defined by portions of the inner single-conductor transmission line and the outer single-conductor transmission line; and ii) a second outer conductor comprising an outer boundary separating an evaporated zone and the hydrocarbon formation, wherein the electromagnetic energy generates electromagnetic heating to produce the evaporated zone in the hydrocarbon formation surrounding the antenna module.

11. The antenna module of claim 8, wherein the conductive member has least one exposed conductive member portion, and the antenna module further comprises:

at least one segment of an inner single-conductor transmission line defined by the at least one exposed conductive member portion; and at least one segment of an outer single-conductor transmission line defined by the outer conductive surface of the at least one conductive sheath.

12. The antenna module of claim 11, wherein the conductive member has a diameter that varies along its length such that the diameter is larger at the at least one exposed conductive portion relative to the at least one portion of the conductive member surrounded by the at least one conductive sheath to produce a flared conductive member.

13. The antenna module of claim 8, wherein the at least one feed connector is located between two ends of the segment of coaxial transmission line.

14. The antenna module of claim 13, wherein the at least one feed connector comprises a plurality of feed connectors that are azimuthally arranged around the inner conducting surface of the pipe.

15. The antenna module of claim 13, wherein the at least one feed connector comprises a plurality of feed connectors that are arranged axially along the inner conducting surface of the pipe.

16. The antenna module of claim 13, wherein the at least one feed connector is located near one end of the segment of coaxial transmission line.

17. The antenna module of claim 16, wherein the segment of coaxial transmission line has an electrical length that is substantially one half of a wavelength of the electromagnetic energy oscillating at a target frequency such that a substantially perfect electric conductor boundary condition is defined in a plane that is situated at a mid-point of the segment of coaxial transmission line and oriented transversely relative to a longitudinal axis defined the conductive member.

18. The antenna module of claim 16, wherein the segment of coaxial transmission line has an electrical length that is substantially an odd multiple of one half of a wavelength of the electromagnetic energy oscillating at a target frequency.

19. The antenna module of claim 13, wherein the at least one feed connector is located near a midpoint of the segment of coaxial transmission line.

20. The antenna module of claim 19, wherein the segment of coaxial transmission line has an electrical length that is substantially one half of a wavelength of the electromagnetic energy oscillating at a target frequency such that a substantially perfect magnetic conductor boundary condition is defined in a plane that is situated at a mid-point of the segment of coaxial transmission line and oriented transversely relative to a longitudinal axis defined the conductive member.

21. The antenna module of claim 8, wherein the enclosed cavity comprises at least one dielectric material to separate the inner and outer conductor of the segment of coaxial transmission line.

22. The antenna module of claim 1, wherein the seal is configured with at least one of the following properties: i) prohibits flow of fluids from the hydrocarbon formation into the enclosed cavity; ii) chemically inert; and iii) electrically insulating.

23. The antenna module of claim 22, wherein the seal is toroidal in shape with a rectangular cross-section and further comprises concentric inner and outer structural rings, the inner structural ring located proximally to the conductive member and the outer structural ring located proximally to the conductive sheath.

24. The antenna module of claim 23, wherein the inner and outer structural rings have an electrical loss tangent of less than 0.01.

25. A method for electromagnetic heating of a hydrocarbon formation comprising:

deploying at least one antenna module into the hydrocarbon formation, the at least one antenna module comprising:

a conductive member defined by a pipe;

at least one conductive sheath with a first and second end surrounding at least one portion of the conductive member;

at least one feed transmission line extending within the pipe that delivers the electromagnetic energy to the antenna module;

at least one feed connector disposed within the pipe, each feed connector electrically connected to:

i) one of the at least one feed transmission line at a first feed connector port; and ii) at a second connector port, at least one of a) an inner conducting surface of the pipe and b) an inner conducting surface of one of the at least one conductive sheath; and an electrically insulating seal inserted at the first and second end of each of the at least one conductive sheath between the conductive member and the conductive sheath to maintain an enclosed cavity defined by the conductive member, the conductive sheath and the electrically insulating seal for electrically separating the conductive member and the conductive sheath;

operating at least one electromagnetic wave generator to generate at least one electromagnetic wave having at least one target frequency;

electrically coupling the at least one antenna module to the at least one electromagnetic wave generator; and delivering at least one electromagnetic wave to the hydrocarbon formation, the electromagnetic wave corresponding to electromagnetic energy used to generate heat within the hydrocarbon formation.

26. The method of claim 25, wherein the electrically coupling comprises coupling a first electromagnetic wave generator to a first set of antenna modules and coupling a second electromagnetic wave generator to a second set of antenna modules so that the first set of antenna modules irradiates the hydrocarbon formation independently relative to the second set of antenna modules.

27. The method of claim 26, the method further comprises configuring the first electromagnetic wave generator to generate a first electromagnetic wave at a first frequency; and configuring the second electromagnetic wave generator to generate a second electromagnetic wave at a second frequency, wherein the first frequency is different from the second frequency.

28. The method of claim 25, wherein the deploying the at least one antenna module comprises connecting a plurality of antenna modules to form at least one module chain and deploying the at least one module chain into the hydrocarbon formation, wherein each antenna module in the plurality of antenna modules is connectable to another antenna module using a first and second electrically conductive connector located at a respective first member end and a second member end of the conductive member so that each module chain comprises a contiguous conductive member.

29. The method of claim 25 further comprising determining a length of the at least one conductive sheath based on at least one of i) the at least one target frequency;

ii) an outer diameter of the conductive member;

iii) an outer diameter of the at last one conductive sheath;

iv) material occupying the enclosed cavity; and v) electrical characteristics of the hydrocarbon formation.

* * * * *